US005337551A

United States Patent [19]

Grecksch et al.

[11] Patent Number: 5,337,551

[45] Date of Patent: Aug. 16, 1994

[54] TEXTILE MACHINE TUBE TRANSPORT ASSEMBLY WITH FULL PACKAGE AND EMPTY TUBE CAPABILITY

[75] Inventors: Hans Grecksch, Monchen-Gladbach; Thomas Heidtmann, Krefeld; Norbert Bohnen, Monchen-Gladbach, all of Fed. Rep. of Germany

[73] Assignee: W. Schlafhorst AG & Co., Monchen-Gladbach, Fed. Rep. of Germany

[21] Appl. No.: 787,232

[22] Filed: Nov. 4, 1991

Related U.S. Application Data

[63] Continuation-in-part of Ser. No. 538,830, Jun. 15, 1990, abandoned.

[30] Foreign Application Priority Data

Jun. 15, 1989 [DE] Fed. Rep. of Germany ..... 3919525
Nov. 2, 1990 [DE] Fed. Rep. of Germany ..... 4034824

[51] Int. Cl.[5] ..... D01H 9/10; D01H 9/00

[52] U.S. Cl. ..... 57/281; 57/90; 57/264; 242/35.5 A

[58] Field of Search ..... 198/465.1, 465.2; 242/355 A; 57/281, 90, 266, 274, 275, 277

[56] References Cited

U.S. PATENT DOCUMENTS 3,924,762 12/1975 Igel ..... 57/281
4,411,354 10/1983 Thibault et al. ..... 198/465.1
4,790,131 12/1988 Uchida ..... 57/90 X
5,103,627 4/1992 Stadele et al. ..... 57/90 X
5,177,949 1/1993 Stadele et al. ..... 57/281
5,179,829 1/1993 Grecksch et al. ..... 57/90 X
5,185,993 2/1993 Fritschi et al. ..... 57/90 X

FOREIGN PATENT DOCUMENTS 71741 5/1982 Japan ..... 198/465.2

*Primary Examiner*—Daniel P. Stodola
*Assistant Examiner*—William Stryjewski
*Attorney, Agent, or Firm*—Shefte, Pinckney & Sawyer

[57] ABSTRACT

A tube transport assembly is provided for a textile machine system in which tubes having yarn or the like wound thereon are transported to, and empty tubes are transported from, a textile machine. Two different transport apparatus are each operable to transport a different kind of tube support member along a respective endless transport path. In one aspect of the present invention, an alternating positioning device alternately positions the two types of tube support members and a tube transfer device is operable to transfer the tubes and full yarn packages from the type of tube support members on which they are initially supported to the other type of tube support members. In one embodiment of the tube transport assembly, the alternating positioning device is a rotatable annular disk having a plurality of tube support member retaining positions uniformly spaced annularly thereon. In another embodiment of the present invention, the alternating positioning device controls the feed of tube support members to a coextensive travel path in which both endless transport paths are coextensive, the feed of the tube support members being controlled to produce an alternating arrangement of the two different types of tube support members.

33 Claims, 9 Drawing Sheets

Fig. 2
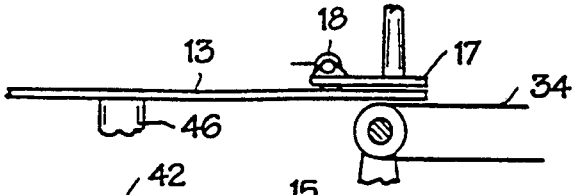
Fig. 3
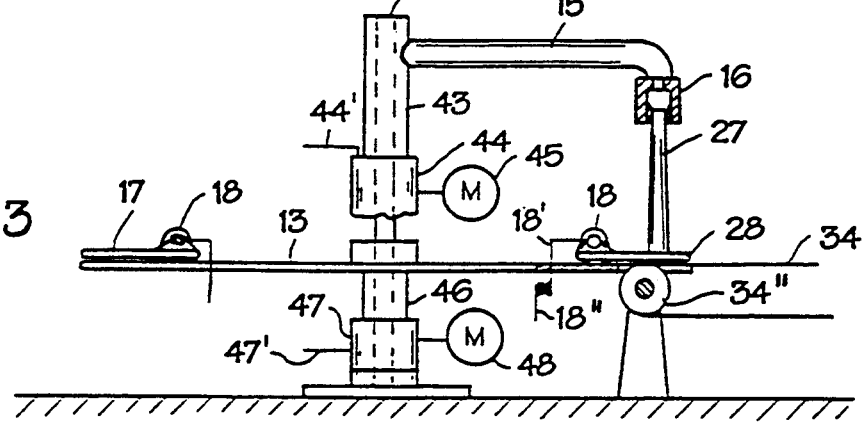
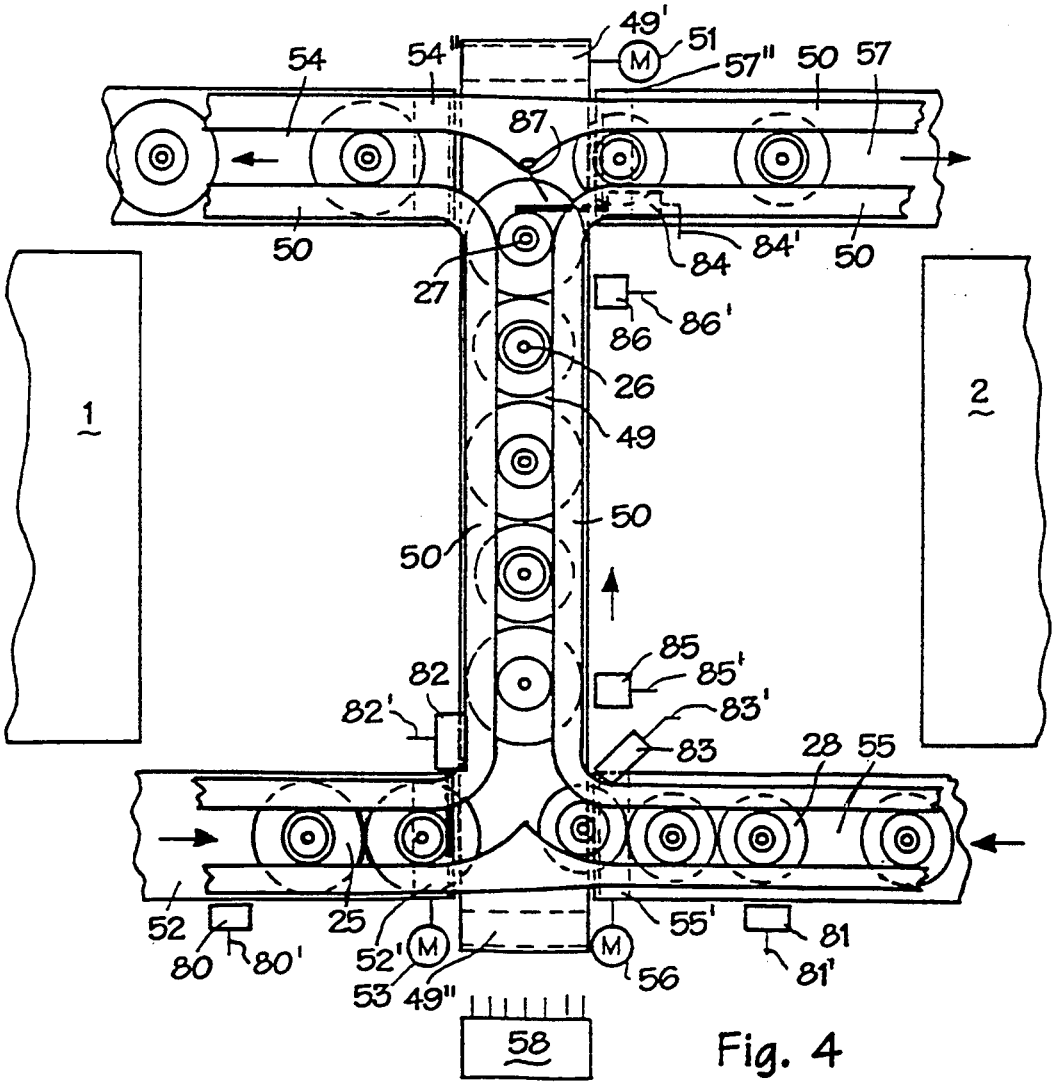
Fig. 4

Fig. 7
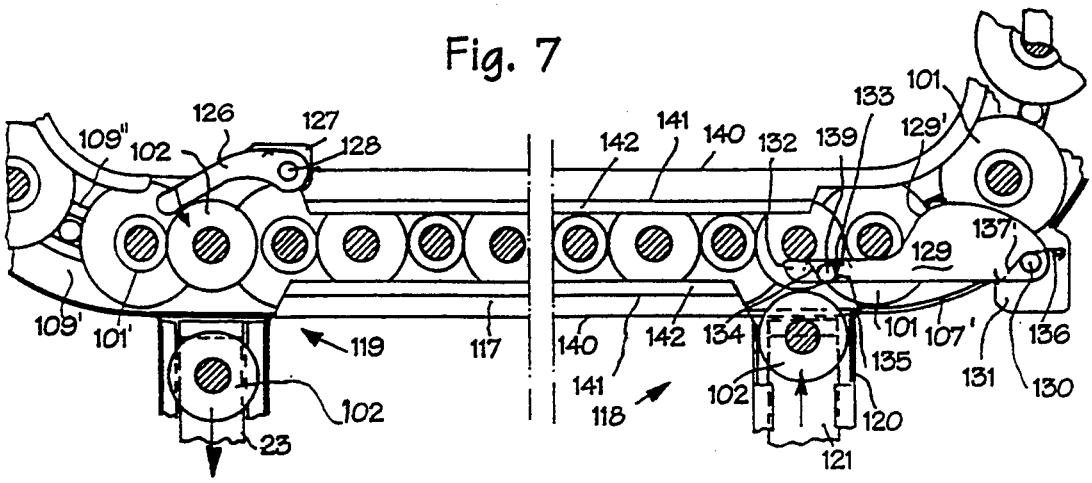
Fig. 8
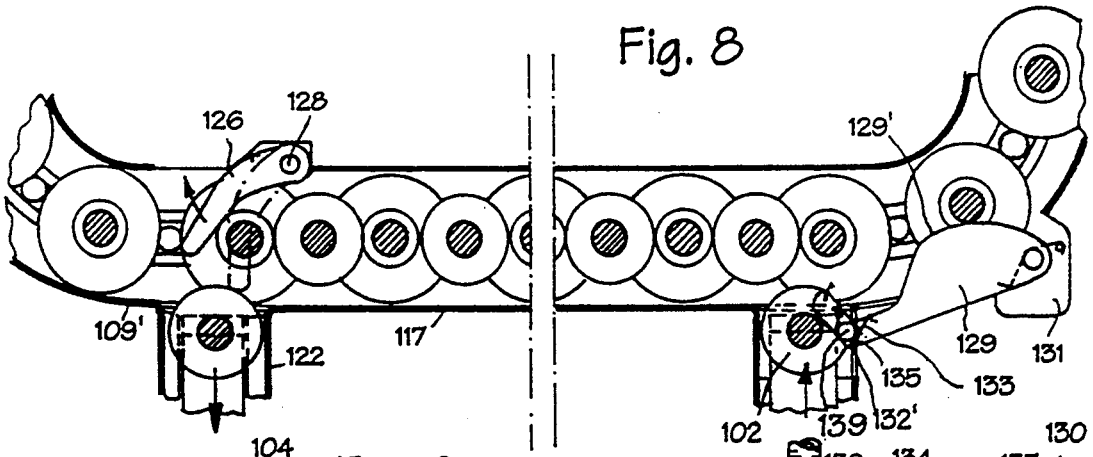
Fig. 8a
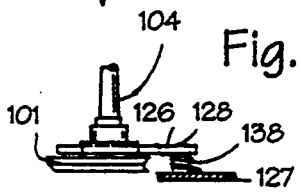
Fig. 8b
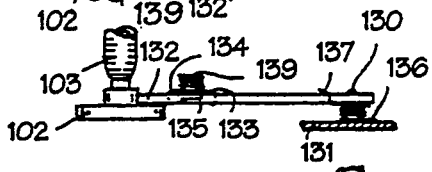
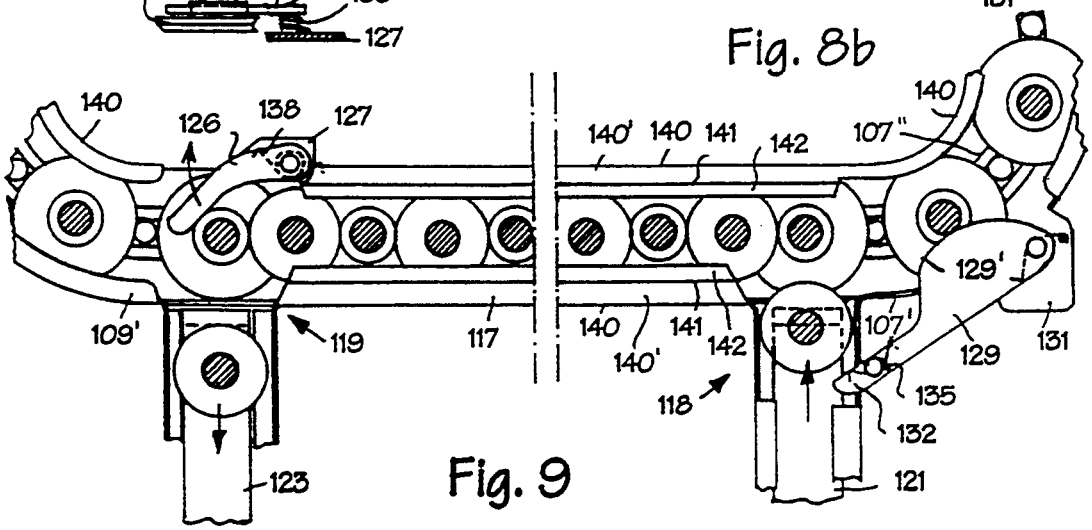
Fig. 9

TEXTILE MACHINE TUBE TRANSPORT ASSEMBLY WITH FULL PACKAGE AND EMPTY TUBE CAPABILITY

RELATION TO OTHER APPLICATIONS

This is a continuation-in-part of co-pending application Ser. No. 538,830, filed Jun. 15, 1990, now abandoned.

BACKGROUND OF THE INVENTION

The present invention relates to a tube transport assembly of a textile machine system having the capability to transfer full packages and empty tubes between tube support members.

It is known to provide a tube transport assembly for a textile machine having a plurality of peg tray-type tube support members for individually supporting and transporting tubes through yarn processing stations at which yarn is wound or unwound from the tubes. It is further known to operatively interconnect two different types of textile machines such as, for example, a spinning machine and a winding machine, wherein the production of each machine is related to the production of the other machine. In German Offenlegungsschrift 32 35 442, a textile machine system is disclosed in which a spinning machine is operatively interconnected with a winding machine. The two machines are positioned next to each other for transport of the tube support members in a closed loop around both machines. In this regard, both of the textile machines must be configured to accommodate a uniform tube support member configuration. However, all machines that may desirably be interconnected, do not accommodate the same configuration or size tube support members. Accordingly, the need exists for a textile machine system in which at least two different configurations of tube support members can be transported in respective different closed loops so that each of the textile machines of the textile machine system can be provided with tube support members of a specific configuration best suited for use with the particular textile machine.

SUMMARY OF THE INVENTION

The present invention provides a tube transport system in which tubes are transferred from the tube support members of one machine to the tube support members of the other machine, and, therefore, the tube support members need not be the same size or configuration.

Briefly described, the present invention provides a tube transport assembly for a textile machine system in which tubes having yarn or the like wound thereon are transported to, and empty tubes are transported from, a textile machine. The tube transport assembly includes a plurality of first tube support members for individually supporting tubes thereon for transport therewith and a plurality of second tube support members for individually supporting tubes thereon for transport therewith. The assembly also includes a first transport means for transporting the plurality of first tube support members along a first endless transport path associated with the textile machine and a second transport means for transporting the plurality of second tube support members along a second endless transport path. The assembly additionally includes tube transfer means for transferring tubes from first tube support members transported along the first endless transport path to the second tube support members transported along the second transport path and for transferring tubes from the second tube support members to the first tube support members.

According to one aspect of the present invention, the textile machine is a winding machine having winding stations and the textile machine system further includes a spinning machine having spinning stations and operatively associated with the winding machine. In this aspect of the present invention, the second transport path is associated with the spinning machine and includes a tube transfer portion and the second tube support members support the tubes for transport thereof to the spinning stations for building yarn onto the tubes to form full packages and support the full packages for transport thereof from the spinning stations to the tube transfer portion for transfer of the full packages to the first tube support members by the tube transfer means. Also, the first transport path is associated with the winding machines and includes a tube transfer portion, and the first tube support members support the full packages for transport thereof from the transfer portion of the first transport path to the winding stations at which yarn is unwound from the full packages and support the tubes for transport of empty tubes to the transfer portion of the first transport path for transfer of the empty tubes to the transfer portion of the second transport path by the tube transfer means.

In a further feature of the one aspect of the present invention, the tube transfer portions are positioned adjacent one another for transfer by the tube transfer means of the full packages to the first tube support members and transfer of the empty tubes to the second tube support members during transport of the first and second tube support members through the tube transfer portions. In a variation of the one aspect of the present invention, the first and second tube transfer portions are at least partially coextensive. The variation can additionally include the feature that the tube transfer means is operable to simultaneously transfer a plurality of full packages and a plurality of empty tubes.

The variation of the one aspect of the present invention includes the further feature of alternating positioning means for positioning the first tube support members in alternating manner with the second tube support members in the at least partially coextensive transfer portions.

In another variation of the one aspect of the present invention, there is provided alternating positioning means for positioning the first tube support members in alternating manner with the second tube support members in the at least partially coextensive transfer portions, and the tube transfer means is operable to simultaneously transfer the full packages from the second tube support members to the first tube support members and the empty tubes from the first tube support members to the second tube support members.

In regard to the features of the variation of the one aspect of the present invention, the alternating positioning means includes means for advancing the first and second tube support members along the at least partially coextensive tube transfer portions and feed control means for controlling the feed of the first and second tube support members to the advancing means to effect alternate positioning of the first and second tube support members on the advancing means. Also, the feed control means is operable to contemporaneously feed the first and second tube support members to the advancing means. Alternately, the feed control means may be operable to alternately feed the first and second tube support members to the advancing means.

In a further feature of the variation of the one aspect of the present invention, the spacing between each respective tube support member positioned on the advancing means for transfer is uniform and the tube transfer means and the advancing means are movable relative to one another to effect movement of the empty tubes engaged by the tube transfer means to release positions for release of the empty tubes onto the second tube support members and movement of the full packages engaged by the tube transfer means to release positions for release onto the first tube support members. Additionally, the advancing means is operable to advance the first and second tube support members along the at least partially coextensive tube transfer portions in movements in which the extent of travel corresponds to multiples of the uniform spacing and the tube transfer means is operable to periodically engage the empty tubes and the full packages in correspondence with a predetermined number of the movements of the advancing means. Moreover, the tube transfer means can be configured to be operable to periodically engage the empty tubes and the full packages in correspondence with each advancing movement of the advancing means.

The variation of the one aspect of the present invention also includes the feature that the tube transfer means is operable to move the empty tubes and the full packages to clearance positions out of interference with the first and second tube support members during transfer of the empty tubes and the full packages.

According to a further aspect of the present invention, the advancing means includes a rotatable annular tube support member retaining member and means for rotating the annular tube support member retaining member, the rotatable annular member having an odd number of tube support member retaining positions uniformly spaced annularly thereon for supporting the first and second tube support members on the tube support member retaining member in alternating positions. This further aspect of the present invention also includes the features that the first transport means is operable to transport the first tube support members to an empty tube feed location for feed of the first tube support members, with the empty tubes thereon, onto the tube support member retaining member, and to transport the first tube support members from a full package discharge location at which the first tube support members, with the full packages supported thereon, are discharged from the rotatable annular member and the second transport means is operable to transport the second tube support members to a full package feed location for feed of the second tube support members, with the full packages thereon, onto the rotatable annular member and to transport the second tube support members from an empty tube discharge location at which the second tube support members, with the empty tubes supported thereon, are discharged from the rotatable annular member. Each feed and discharge location is in register with one of the tube support member retaining positions of the rotatable annular member upon completion of an advancing movement thereof and the feed and discharge locations associated with each respective first and second transport means are spaced from one another in the direction of advance of the rotatable annular member with an odd number of tube support member retaining positions therebetween. According to additional features of the further aspect of the present invention, the advancing means includes a plurality of releasable retaining assemblies, each disposed at a respective one of the tube support member retaining positions, to selectively releasably position and retain the first and second tube support members at the tube support member retaining positions. Also, the tube transfer means is operable to vertically raise the empty tubes and the full packages to clearance positions out of interference with vertical posts of the tube support members from which they are raised and the rotating means is operable to drivingly rotate the rotatable annular member in an advancing movement while the empty tubes and the full packages are held in their clearance positions to effect alignment of the empty tubes and the full packages with the vertical posts of the respective tube support members to which they are being transferred.

In yet another feature of the further aspect of the present invention, the tube transfer means includes a rotatable operating member rotatable concentrically with the rotatable annular tube support member retaining member, and a plurality of individual tube grippers annularly aligned with the tube support member retaining positions of the rotatable annular tube support member retaining member and mounted on the rotatable operating member for rotation therewith to engage, transfer and release gripped packages and tubes at respective retaining positions.

In an additional feature of the one aspect of the present invention, each of the first and second tube support members includes a base component and a tube retaining component mounted on the base component, the tube retaining component for retaining a tube in an upright disposition on the respective tube support member, and spacing means for maintaining each of the first tube support members at a spacing from each adjacent first tube support member during advancing movement of the tube support members along the coextensive transport path. The spacing is selected such that a respective one of the second tube support members can be disposed in overlapping relation on the adjacent pair of first tube support members at the feed location for mutual support of the respective second tube support member by the adjacent first tube support members with the base component of the respective second tube support member being supported on the base components of the adjacent first tube support members. According to further details of this additional feature, each base component of each first tube support members has a top surface and the second transport means includes feeding ready support means for supporting a second tube support member in a feeding ready position at the feed location in which the second tube support member is supported for subsequent movement thereof onto an adjacent pair of the first tube support members being advanced along the coextensive transport path. The vertical position of the feeding ready support means is selected such that the respective second tube support member in the feeding ready position is at least at the same vertical level as the top surfaces of the base components of the adjacent pairs of the first tube support members being advanced along the coextensive transport path, whereby the respective second tube support member can be readily fed from its the feeding ready position into its supported overlapping position on adjacent first tube support members.

According to yet further details of the additional feature of the one aspect of the present invention, the second transport means includes discharge receiving means for receiving each second tube support member as it is discharged from the coextensive transport path, the vertical position of the discharge receiving means being at a vertical level no higher than the top surfaces of the base components of the first tube support members in the coextensive transport path at the discharge location. In one variation, the base component of each of the first tube support members is annular and the tube retaining component of each of the first tube support members includes a generally annular neck portion coaxially mounted on the annular base component and a post portion coaxially mounted on the generally annular neck portion and extending therefrom, the neck portion for supporting thereon a tube inserted over the post portion, and the spacing means includes means for maintaining adjacent first tube support members in said coextensive transport path at a spacing from one another such that the spacing between the annular neck portions of the adjacent first tube support members is at least equal to the diameter of the annular base portion of a second tube support member.

The spacing means preferably includes a plurality of projecting members, projecting between adjacent support members in the coextensive transport path and means for moving the projecting members along the coextensive transport path with the projecting members at a uniform spacing from one another to effect advancing movement of the first tube support members along the coextensive transport path at constant uniform spacings from one another during their transport. Also, the base component of each of the second tube support members is preferably annular and the tube retaining component of each of the second tube support members includes a generally annular neck portion coaxially mounted to the annular base component and a post portion coaxially mounted to the generally annular neck portion and extending therefrom, the neck portion for supporting thereon a tube inserted the post portion, and the axial extent of the base portion of the second tube support members is substantially equal to the axial extent of the neck portion of the first tube support members.

According to yet additional details of the additional feature of the one aspect of the present invention, the second transport means is operable to automatically feed a second tube support member in the feeding ready position to a supported disposition on an adjacent pair of the first tube support members and the assembly further comprises means for controlling the feed of a second tube support member from the feeding ready position in correspondence with the alignment of an adjacent pair of the first tube support members with the feeding ready position. Also, the controlling means preferably includes a blocking member movable between a feed blocking position in which the blocking member extends across the travel path of a second tube support member in the feeding ready position for resisting feeding movement of the second tube support member from the feeding ready position and a clearance position in which the blocking member is out of interference with the second tube support member in the feeding ready position and means for biasing the blocking member into the blocking position. Furthermore, the first transport means preferably includes a guide channel along which the first tube support members are guided into the coextensive transport path and further comprising a pivot for pivotally mounting the blocking member to the guide channel, and the biasing means includes a spring mounted on the pivot of the blocking member.

According to further additional details of the additional feature of the one aspect of the present invention, the tube transport assembly further comprises means for moving the second tube support members at an angle to the direction of travel of tube support members along the coextensive transport path to effect discharge of the second tube support members at the discharge location onto the discharge receiving means of the second transport means. Preferably, the means for moving the second tube support members at an angle includes a pusher element and means for selectively moving the pusher element between a clearance position at which it is out of interference with the first and second tube support members in the coextensive transport path and an extended position at which it engages a respective one of the second tube support members being supported at the discharge location to effect movement of the second tube support member from the respective adjacent first tube support members on which it is supported onto the discharge receiving means. Also, the discharge receiving means is preferably disposed laterally adjacent one side of the coextensive transport path and an ejection member is pivotally mounted laterally adjacent the opposite side of the coextensive transport path and means for biasing the ejection member to pivot laterally inwardly of the coextensive transport path to engage each second tube support member at the discharge location to thereby effect movement of the second tube support members onto the discharge receiving means.

According to yet another detail of the additional feature of the one aspect of the present invention, there is provided first guide means for engaging the first tube support members in the coextensive transport path to maintain the first tube support members in alignment during their transport and second guide means for engaging the second tube support members in the coextensive transport path to maintain the second tube support members in alignment during their transport by the first tube support members in the coextensive transport path.

According to an additional aspect of the present invention, the tube transfer means includes means for simultaneously vertically moving the gripped tubes to clearance positions above the first and second tube support members in the coextensive transport path, the simultaneously vertical moving means being operable to maintain the gripped tubes in their vertical clearance positions during advancing movement of the first and second tube support members therebelow in the coextensive transport path and to lower tubes gripped from first tube support members onto second tube support members and tubes gripped from second tube support members onto first tube support members.

According to an additional further aspect of the present invention, the tube transport assembly further comprises means for controlling the feed of the second tube support members onto adjacent first tube support members at the feed location, the controlling means controlling the second transport means to stop the feed of the second tube support members in coordination with the completion of feeding of a predetermined number of the second tube support members onto the first tube support members and for controlling the tube transfer means to perform a tube transfer operation resulting in a first tube support member without a tube thereon in coordination with the completion of feeding of the predetermined number of the second tube support members onto the first tube support members and to lower tubes gripped from first tube support members onto second tube support members and tubes gripped from second tube support members onto first tube support members and signal means for signalling the passage therepast of the first tube support member without a tube thereon, the controlling means controlling the second transport means to resume the feeding of the second tube support members onto adjacent first tube support members in response to the signal. Also, the tube transport assembly includes means for moving the first and second tube support members in the coextensive transport path in a direction opposite to the direction of advancing movement in coordination with the transfer of tubes between the tube support members.

According to a different further aspect of the present invention, the tube transport assembly includes means for moving the means for simultaneously gripping a plurality of tubes by a predetermined amount in the direction of movement of tube support members in the transfer path to thereby align each gripped tube with the other type of the first and second tube support members different than the one type of the first and second tube support members on which the tube is initially supported.

BRIEF DESCRIPTION OF THE DRAWINGS

FIG. 2 is a side elevational view of a portion of the alternating positioning means and associated transport means of the tube transport assembly shown in FIG. 1;

FIG. 3 is a side elevational view of a portion of the alternating positioning means and transport means shown in FIG. 2 and showing further details;

FIG. 4 is a plan view of a textile machine system comprising a spinning machine and a winding machine and showing another embodiment of the tube transport assembly of the present invention installed thereon;

FIG. 7 is a plan view of a portion of the tube transport assembly shown in FIG. 6 and showing a variation of the alternating positioning means at an operational position thereof immediately before a tube support member is fed to the alternating positioning means from the spinning machine;

FIG. 8 is a plan view of a portion of the textile machine system shown in FIG. 7 and showing the alternating positioning means at an operational position thereof as a tube support member is fed to the alternating positioning means and another tube support member is discharged from the alternating positioning means;

FIG. 8*a* is a front elevational view of the discharge assembly of the alternating positioning means shown in FIGS. 7 and 8;

FIG. 8*b* is a front elevational view of the feed control assembly of the alternating positioning means shown in FIGS. 7 and 8;

FIG. 9 is a plan view of the textile machine system shown in FIGS. 7 and 8 and showing the alternating positioning means at an operating position immediately after a tube support member has been discharged therefrom;

DETAILED DESCRIPTION OF THE PREFERRED EMBODIMENTS

Figure 1:
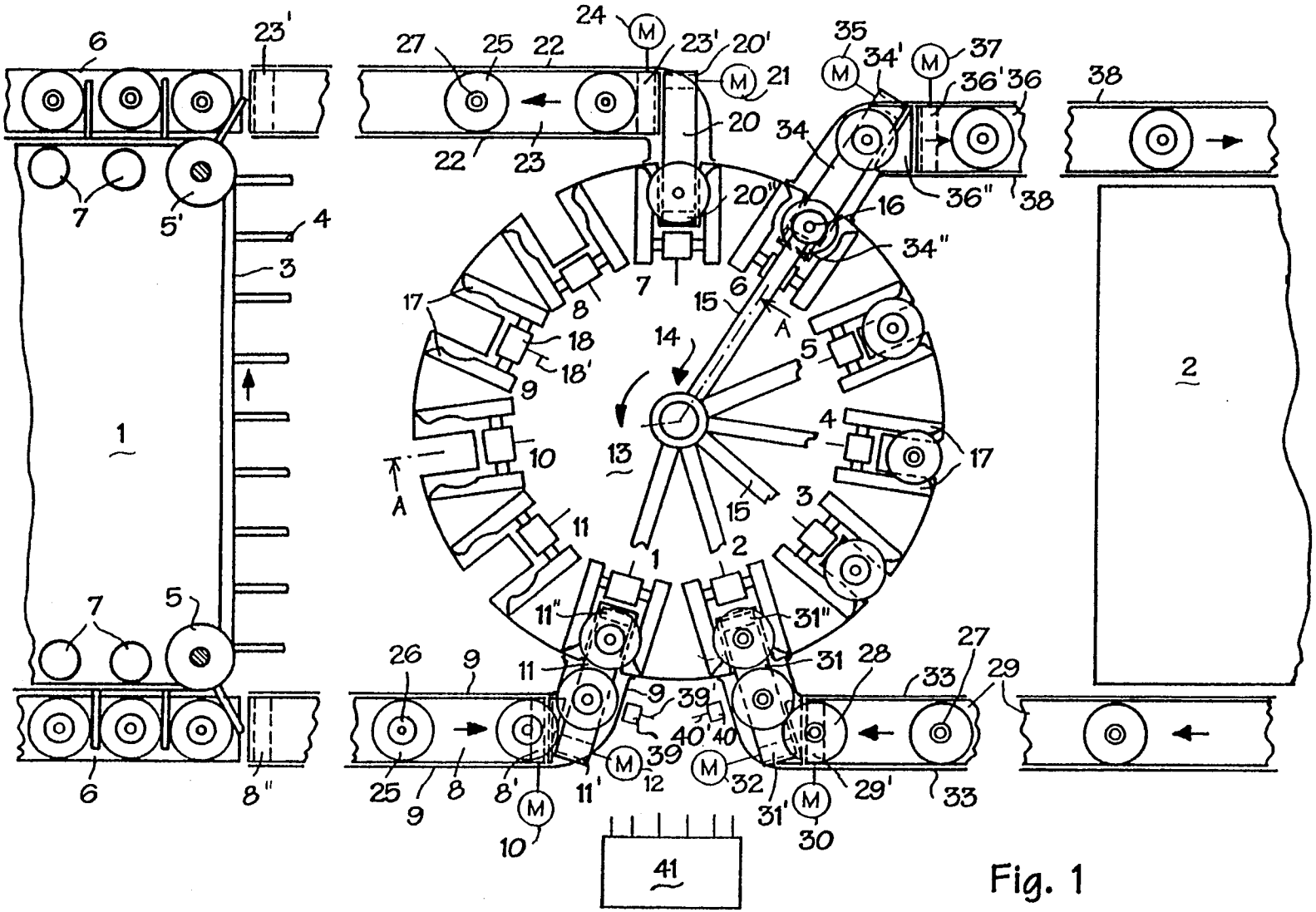
FIG. 1 is a plan view of a textile machine system comprised of a spinning machine and a winding machine and showing one embodiment of the tube transport assembly of the present invention operatively installed in the textile machine system.

In FIGS. 1–3, a textile machine system comprising a spinning machine 1 and a winding machine 2 is illustrated and one embodiment of the tube transport assembly of the present invention is shown as it is operatively installed on the textile machine system. The spinning machine 1 includes a flexible endless member or belt 3 in the form of a flexible steel band having a flat side vertically oriented during travel of the band. The belt 3 is trained around a conventional drive roller (not shown) and a plurality of guide rollers including two guide rollers 5,5' which are shown in FIG. 1. A plurality of transversely projecting members 4 are secured to the belt 3 at uniform spacing along the endless extent of the belt. The uniform spacing between each adjacent pair of the projecting members 4 is slightly larger than the diameter of an annularly shaped tube support member of the type which supports tubes in upright dispositions for travel around the spinning machine 1. A pair of sliding support members 6 extend along each longitudinal side of the spinning machine 1 for sliding support of the plurality of tube support members therealong. The belt 3 and the sliding support member 6 cooperate to effect sliding movement of the tube support members along the sliding support member 6 for positioning the tube support members adjacent the spindles 7 of the spinning machine 1 and for transporting the tube support members to and from their spindle adjacent positions. Each adjacent pair of the projecting members 4 releasably receives a tube support member therebetween to propel the tube support member in sliding movement along the respective one of the sliding support members 6 during endless travel of the belt 3. The projecting members receive tube support members supporting an empty tube thereon from a spinning machine delivery belt 23 that travels around a drive roller 23' driven by a motor 24. The belt 23 which has its downstream end disposed adjacent an end of one of the sliding support members 6. The tube support members received between the adjacent pairs of the projecting members 4 are slid along the sliding support member 6 by the endless movement of the belt 3 to respective positions adjacent the spindles 7 and the empty tubes supported on the tube support members are then transferred in conventional manner onto the spindle 7 for the building of yarn thereon to form full packages. Once full packages have been built on the tubes, the tubes are doffed from the spindles 7 in conventional manner onto the tube support members, which have remained in their spindle adjacent positions during the yarn package building. The endless belt 3 is then operated to effect sliding movement of the tube support members supporting the full packages along the sliding support member 6 to a discharge end, which is the downstream end of the lower sliding support member 6 shown in FIG. 1. The tube support members supporting the full packages are discharged onto the upstream end of a spinning machine discharge belt 8, which is trained around a conventional guide roller 8'' and a conventional drive roller 8' driven by a motor 10.

A pair of guide plates 9 are disposed on opposite lateral sides of the travel path of the spinning machine discharge belt 8 and each includes a contoured portion extending beyond the travel path of the spinning machine discharge belt 8 adjacent the travel path of the short feed belt 11. The guide plates 9 guide the transfer of spinning machine tube support members 25 from the discharge belt 8 to the feed belt 11. The pair of sliding support members 6 are interconnected at their respective ends which are not illustrated in FIG. 1 by an interconnecting sliding support member so that the tube support members are transported by the projecting members 4 along the interconnecting slide support member between the sliding members 6.

The winding machine 2 includes a winding machine delivery belt 36 trained around a conventional guide roller (not shown) and a conventional drive roller 36', which is operatively connected to a drive motor 37 for driving operation of the winding machine delivery belt 36. The winding machine delivery belt 36 comprises a portion of the conventional delivery assembly for delivering the tube support members supporting the full packages from a full package receiving location to the winding stations of the winding machine for unwinding of the full packages thereat. A conventional discharge assembly for transporting the tube support members from the winding stations and ultimately to a location for transferring the empty tubes to the spinning machine 1 includes a winding machine discharge belt 29 trained around a conventional guide roller (not shown) and a conventional drive roller 29', which is connected to a conventional drive motor 30 for driving operation of the belt 29.

The spinning machine delivery belt 23 and the spinning machine discharge belt 8 are operatively interconnected with one another for the transport of tube support members therebetween, in a manner described in more detail below, such that the spinning machine tube support members 25 of the spinning machine 1 are transported around the spinning machine in an endless transport path comprised of the delivery belt 23, the sliding support members 6, the interconnecting sliding support member, the discharge belt 8 and the means operatively interconnecting the belts 8 and 23.

The winding machine discharge and delivery belts 29 and 36 are operatively interconnected to one another by an interconnecting means described in more detail below and by transport of the tube support member through the winding stations to form an endless transport path for the transport of the winding machine tube support members 28 around the winding machine 2. With this arrangement, the spinning machine tube support members 25 associated with the spinning machine 1 and the winding machine tube support members 28 associated with the winding machine 2 travel only around their respective machines. For this reason, the tube support members 25,28 for the two machines can be differently configured or sized without the need for sorting devices to sort the tube support members to their appropriate endless transport path. However, it is not necessary that they be differently configured or sized.

The tube transport assembly of the present invention provides tube transfer means for transferring tubes between the spinning machine tube support members 25 and the winding machine tube support members 28. The tube transfer means includes an alternating positioning means in the form of a rotatable annular tube support member retaining member or disk 13 and means for rotating the disk 13. As best seen in FIG. 1, the disk 13 has an odd number of tube support member retaining positions 1–11 uniformly spaced annularly thereon for supporting the tube support members 25,28 on the disk 13 in alternating positions.

As seen in FIGS. 2 and 3, the disk 13 is in the form of an annular rigid plate having a cylindrical rotation sleeve 46 mounted thereto and projecting perpendicularly therefrom coaxial with the axis of rotation of the disk 13. The plate has a central annular throughbore having the same diameter as the inner diameter of the cylindrical rotation sleeve 46. The disk 13 is mounted on a rotation shaft 42 which extends through the cylindrical rotation sleeve 46 and the central annular throughbore of the disk 13. The cylindrical rotation sleeve 46 is operatively interconnected to a rotation transmission member 47, which is operatively connected to a drive motor 48. The rotation transmission member 47 drivingly rotates the cylindrical rotation sleeve 46 about the rotation shaft 42 in correspondence with the driving operation of the motor 48. The rotation transmission member 47 includes a lifting means which can be in the form, for example, of a conventional hydraulic or pneumatic cylinder and piston assembly, for axially moving the rotation transmission member 47, the cylindrical rotation shaft 46 and the disk 13 relative to the rotation shaft 42.

The rotation transmission member 47 is operatively connected via a connector 47' to the control unit 41 and is operable to incrementally rotate the disk member 13 about the rotation shaft 42 in incremental movements in which the extent of angular travel of the disk 13 corresponds to multiples of the uniform angular spacing between the tube support member retaining positions 19. Additionally, the rotation transmission member 47 is operable to selectively vertically raise and lower the disk member 13 relative to the rotation shaft 42.

As best seen in FIG. 1, each tube support member retaining position 1–11 includes a belt receiving recess extending radially inwardly from the circumference of the disk 13 for receiving a belt therein and a releasable retaining assembly for selectively releasably positioning and retaining a tube support member at the tube support member retaining position. Each releasable retaining assembly includes a pair of gripping arms 17 and a conventional hydraulic cylinder and piston assembly 18. Each gripping arm 17 is securely mounted at one end to a piston of the cylinder and piston assembly 18 and the gripping arms extend adjacent the opposite sides of the belt receiving recess of the respective tube support retaining position 1–11. Each gripping arm 17 includes an arcuately shaped concave portion compatibly configured with the annular periphery of the base portion of the tube support members 25,28. Each cylinder and piston assembly 18 is operable to selectively move the gripping arms 17 relatively toward one another for gripping therebetween the annular base portion of a tube support member 25,28 to thereby retain and position the tube support member at the tube support member retaining position 1–11 in response to a conventional operating control through a control line 18'.

The tube transfer means additionally includes a tube gripping assembly 14 having a concentric mounting sleeve 43 and a plurality of tube gripper arms 15 extending radially from the concentric rotating sleeve 43 at uniform angular spacings from one another. As best seen in FIG. 3, each tube gripping arm 15 includes an individual tube gripper 16 mounted at its free end for selectively engaging and releasing an exposed upper end of a tube supported on a tube support member such as, for example, an empty tube 27 supported on a winding machine tube support member 28 or a full tube transported on a spinning machine tube support member 25. The concentric mounting sleeve 43 includes a hollow cylindrical bore for receiving the upper portion of the rotation shaft 42 therein to mount the tube gripping assembly 14 for rotation about the same axis of rotation as the disk 13. The individual tube grippers 16 are annularly aligned with the tube support member retaining positions 1–11 for effecting alignment of the individual tube gripper 16 with the tubes supported in upright dispositions on the tube support members 25,28 which are retained at the tube support member retaining positions 1–11. A rotation transmission member 44 is operatively interconnected to the concentric mounting sleeve 43 and is connected to a drive motor 45. The rotation transmission member 44 is operatively connected via a connector 44' to a control unit 41. The rotation transmission member 44 drivingly rotates the tube gripping assembly 14 about the rotation shaft 42 in correspondence with the driving operation of the motor 45. The rotation transmission member 44 includes a conventional lifting means such as, for example, a conventional hydraulic automatic cylinder and piston assembly, for effecting axial movement of the tube gripping assembly 14 upwardly or downwardly relative to the rotation shaft 42.

As seen in FIG. 3, a plurality of contact signal members 18'', only one of which is shown, are mounted at uniform angular positions relative to the absence of rotation of the disk 13 in annular alignment with the contact members 18' for engaging the contact members 18' to effect operation of the cylinder and piston assemblies 18 of the tube support member retaining positions 1–11. The contact signal members 18'' are operatively connected to the control unit 41.

As seen in FIG. 1, a full package feed assembly includes a short feed belt 11 trained around a guide roller 11'' and a drive roller 11', which is connected to a drive motor 12 for driving operation of the short feed belt 11. The upstream end of the travel path of the short feed belt 11 is disposed relatively adjacent the downstream end of the spinning machine discharge belt 8 for receipt of the spinning machine tube support members 25 transported beyond the downstream end of the spinning machine discharge belt 8. The travel path of the short feed belt 11 extends radially with respect to the axis of the disk 13 and its downstream end is disposed radially inwardly with respect to the circumference of the disk 13.

A sensor 39 is disposed relative to the travel path of the short feed belt 11 for sensing the presence of a spinning machine tube support member 25 on the short feed belt 11. The sensor 39 is connected via a connector 39' to the control unit 41. A sensor 40 is similarly disposed relative to the travel path of the winding machine feed belt 31 for sensing the presence of a winding machine tube support member 28 on the belt 31. The sensor 40 is connected via a connector 40' to the control unit 41.

An empty tube discharge assembly includes a short take-away belt 20 trained around a guide roller 20'' and a drive roller 20', which is connected to a drive motor 21 for driving operation of the take-away belt 20. The travel path of the take-away belt 20 is radially aligned with the axis of the disk 13. The downstream end of the travel path of the take-away belt 20 is positioned relatively adjacent the upstream end of the spinning machine delivery belt 23. The lateral extent of the take-away belt 20 transverse to its endless extent is less than the diameter of the annular base portion of a spinning machine tube support member 25. The upstream end of the travel path of the take-away belt 20 extends radially inwardly relative to the circumference of the disk 13. A pair of guide plates 22 are disposed on opposite lateral sides of the spinning machine delivery belt 23 and each guide plate 22 includes a contoured portion extending beyond the travel path of the spinning machine delivery belt 23 adjacent the travel path of the take-away belt 20 for guiding transfer of the spinning machine tube support members 25 from the take-away belt 20 to the delivery belt 23.

An empty tube feed assembly associated with the winding machine 2 includes a feed belt 31 trained around a guide roller 31'' and a drive roller 31', which is connected to a drive motor 32 for driving operation of the feed belt 31. The travel path of the feed belt 31 is radially aligned with the axis of the disk 13. The upstream end of the feed belt 31 is positioned relatively adjacent the downstream end of the winding machine discharge belt 29. The downstream end of the feed belt 31 is disposed radially inwardly with respect to the circumference of the disk 13. A pair of guide plates 33 are disposed on opposite lateral sides of the winding machine discharge belt 29 and each includes a contoured portion extending adjacent the travel path of the feed belt 31 for guiding the winding machine tube support members 28 from the discharge belt 29 to the feed belt 31.

A full package receipt assembly is associated with the winding machine 1 and includes a short take-away belt 34 trained around a guide roller 34'' and a drive roller 34', which is connected to a drive motor 35 for driving operation of the take-away belt 34. The travel path of the take-away belt 34 is radially aligned with the axis of the disk 13. The downstream end of the take-away belt 34 is positioned relatively adjacent the upstream end of the winding machine delivery belt 36 for the transfer of winding machine tube support members 28 from the take-away belt 34 to the winding machine delivery belt 36. A sliding support platform 36'' having a generally triangular shape is disposed between the take-away belt 34 and the winding machine delivery belt 36 for sliding support of the winding machine tube support members 28 traveling from the take-away belt 34 to the winding machine delivery belt 36. A pair of guide plates 38 are disposed on opposite lateral sides of the winding machine delivery belt 36 and each includes a contoured portion extending adjacent the travel path of the take-away belt 34. The guide plates 38 guide the winding machine tube support members 28 from the take-away belt 34 to the delivery belt 36. The upstream end of the travel path of the take-away belt 34 is disposed radially inwardly of the circumference of the disk 13.

The ends of the travel paths of the feed and take-away belts 11,20,31 and 34 which are disposed radially inwardly of the circumference of the disk 13 respectively define the full package feed location, the empty tube discharge location, the empty tube feed location and the full package discharge location, respectively. Each feed and discharge location is located relative to the disk 13 so as to be in register with one of the tube support member retaining positions 1–11 upon the completion of an advancing movement of the disk 13. The full package feed location defined by the short feed belt 11 and the empty tube receipt location defined by the take-away belt 20 are part of the endless transport path around the spinning machine 1. The empty tube feed location formed by the winding machine feed belt 31 and the full package receipt location formed by the take-away belt 34 are part of the endless transport path of the winding machine 2. The respective feed and discharge locations associated with each respective endless transport path are spaced from one another in the direction of advance of the disk 13 with an odd number of tube support member retaining positions 1–11 therebetween. For example, the full package feed location formed by the short feed belt 11 is spaced from the empty tube discharge location formed by the take-away belt 20 with five tube support retaining positions 1–11 therebetween, and the empty tube feed location formed by the winding machine feed belt 31 is spaced from the full package discharge location formed by the winding machine take-away belt 34 with three tube support retaining positions therebetween.

The rotation transmission member 44 is operable to rotate the tube gripping assembly 14 in incremental movements about the rotation shaft 42 in which the extent of angular travel of the tube gripping assembly 14 in each incremental movement corresponds to multiples of the uniform spacing between the tube support member retaining positions 1–11. Additionally, the rotation transmission member is operable to selectively raise and lower the tube gripping assembly 14 relative to the rotation shaft 42.

The operation of the tube transport assembly illustrated in FIG. 1 is as follows. The full packages doffed from the spindles 7 of the spinning machine 1, which are designated as the full packages 26, are supported on the spinning machine tube support members 25 and transported therewith during transport of the spinning machine tube support members 25 by the belt 3 and projections 4. The spinning machine tube support members 25 are discharged from the sliding support member 6 onto the spinning machine discharge belt 8 for transport thereby to the short feed belt 11. Independently of the transport of the spinning machine tube support members 25 with the full packages 26 thereon, the winding machine discharge belt 29 of the discharge assembly of the winding machine 2 transports the winding machine tube support members 28 with the empty tubes 27 supported thereon to the feed belt 31. The sensor 39 senses the presence of a spinning machine tube support member 25 with a full package on the short feed belt 11 and the sensor 40 senses the presence of a winding machine tube support member 28 with an empty tube thereon on the feed belt 31. In response to this sensing by the sensors 39,40, the control unit 41 controls the contact members 18'' to cause the releasable retaining assemblies of the tube support member retaining positions 1–11 to prepare for the receipt of tube support members. Specifically, the contact members 18'', which are positioned relative to the feed and discharge locations for contacting the contact members 18' of the respective tube support member retaining positions 1–11 in register with the feed and discharge locations and the releasable retaining assemblies of the tube support member retaining positions respond by actuating their cylinder and piston assemblies 18 to move the tube gripping arms away from one another.

In correspondence with the spreading of the tube gripping arms 17, the control unit 41 controls the disk 13 to move from its raised position, as shown in FIG. 2, in which the disk is above the con, non plane in which the feed and take-away belts 11,20,31 and 34 travel, to its lowered position, as shown in FIG. 3, in which the disk is substantially coplaner with the travel paths of the feed and take-away belts 11,20,31 and 34. The belt receiving recesses of the respective tube support member retaining positions 1–11 which are in register with the feed and discharge locations, receive the feed and take-away belts 11,20,31 and 34 therein as the disk member 13 is lowered into its lowered position via operation of the lifting means of the rotation transmission member 47. The driving operation of the belts 11,31 feed the tube support members 25,28, respectively, into the respective tube support member retaining positions 1–11 in register with these two locations (these retaining positions are designated as 1 and 2 in FIG. 1). The cylinder and piston assemblies 18 are then actuated to move the tube gripping arms 17 toward one another to effect gripping of the tube support members 25,28 which have been loaded onto the disk 13 at the full package feed location and the empty tube feed location, respectively.

The control unit 41 now controls operation of the rotation transmission member 47 to first raise the disk 13 above the level of the feed and take-away belts 11,20,31 and 34 and then incrementally rotate the disk 13 in an advancing movement which brings the next pair of the tube support member retaining positions (the positions 10 and 11) into register with the full package feed location and the empty tube feed location. A second spinning machine tube support member 25 and a second winding machine tube support member 28 are then loaded onto the disk in the manner described above. The spinning machine tube support members 25, with the full packages 26 thereon, and the winding machine tube support members 28, with the empty tubes 27 thereon, are thus loaded onto the disk 13 at alternate ones of the tube support member retaining positions 19.

To begin the tube transferring operation, it is necessary that the tube support member retaining position designated as 7 in FIG. 1 at the spinning machine take-away belt 20 have a spinning machine tube support member 25 which does not have a tube thereon. As seen in FIG. 1, at this stage of the tube transfer operation, the three alternate tube support member retaining positions 1,3 and 5 in the direction of advance beginning with the position 1 at the spinning machine feed belt 1 each retain a spinning machine tube support member 25 with a full package 26 thereon and the three alternate tube support member retaining positions 2,4 and 6 beginning with the position 2 at the winding machine feed belt 31 each retain a winding machine tube support member 28 with an empty tube 27 thereon. The control unit 41 then controls the rotation transmission member 44 to lower the tube gripping assembly 14 relative to the rotation shaft 42 such that each tube gripper 16, which is aligned with a respective empty tube 27 or full package 26, is lowered onto the exposed tube end to effect gripping engagement thereof. The rotation transmission member 44 is then controlled to raise the tube gripping assembly 14 relative to the rotation shaft 42 and, thereafter, the rotation transmission member 44 transmits the driving operation of the motor 45 to the tube gripping assembly 14 to effect incremental movement of the tube gripping assembly in the direction of advance of the disk member 13. The incremental movement of the tube gripping assembly 14 corresponds to the spacing between the tube support member retaining positions 1–11 so that each engaged full package 26 is now positioned over the next winding machine tube support member 28 adjacent the spinning machine tube support member 25 on which the full package was originally supported and each empty tube 27 is positioned over the next spinning machine tube support member 25 adjacent the winding machine tube support member 28 on which the empty tube was originally supported. This incremental movement of the tube gripping assembly 14 position of the empty tube 27 originally supported the winding machine tube support member 28 retained at the position 6 of the winding machine take-away belt 34 over the aforementioned initially empty spinning machine tube support member 25 retained at the position 7 of the spinning machine take-away belt 11, and results in no tube or package being positioned over the spinning machine tube support member 25 at the spinning machine feed belt 11.

The control unit 41 thereafter controls the rotation transmission member 44 to lower the tube gripping assembly to effect release of each engaged full package 26 and each engaged empty tube 27 onto the tube support member 25,28 over which it has been aligned. The control unit 41 then controls the releasable retaining assemblies 18 to open the tube gripping arms 17, whereupon the take-away belt 20, transports the previously empty spinning machine tube support 25, which now supports an empty tube 27, from the disk 13 onto the spinning machine delivery belt 23 for circulation through the spinning machine. Concurrently, the take-away belt 34 transports the winding machine tube support member 28 thereat, which now supports a full package 26, from the disk 13 onto the winding machine delivery belt 36 for circulation through the winding machine 2.

Once the take-away belts 20,34 have discharged the respective tube support members 25,28 from the adjacent support member retaining positions 6 and 7, the control unit 41 controls the rotation transmission member 47 to rotate the disk 13 in an incremental movement corresponding to two of uniform spacings of the tube support member retaining positions 1–11. This advancing movement of the disk 13 brings the next two tube support member retaining positions 10 and 11 into register with the take-away belts 20 and 34 and the above-described procedure is repeated to release and discharge the associated tube support members at the same time tube support members 25 and 28 are fed by the feed belts 11 and 31 to the positions 1 and 2. The incremental advancing movement of the disk 13 and the discharge and loading of tube support members 25 and 28 continues in like manner until the spinning machine tube support member 25, which does not support a tube thereon due to the removal of the tube by the tube transfer operation of the tube gripping assembly 14, has been moved into registry with the take-away belt 20 at the empty tube discharge location. At this point, the control unit 41 controls the rotation transmission member 44 to again lower, lift, advance and lower the tube gripping assembly 14 as described above to effect a transfer of the full packages 26 and the empty tubes 27 to adjacent tube support members. The control unit 41 therefore operates the tube gripper assembly 14 to periodically engage the empty tubes 27 and the full packages 26 in correspondence with a predetermined number of movements of the disk 13 required to discharge all of the tube support members to which empty tubes and full packages had been advanced by the preceding operating of the tube gripping assembly 14. The tube support members 25,28 thus remain in their respective spinning machine and winding machine transport paths while transporting the empty tubes 27 and the full packages 26 between paths.

The oncoming tube support members 25,28 at the full package feed location and the empty tube feed location, respectively, are continuously fed along the feed belts 11,31, respectively, radially toward the disk 13. These tube support members 25,28 abut the circumferential surface of the raised disk 13 during rotation of the disk 13 in its incremental movements. In a modification of the embodiment of the tube transport assembly illustrated in FIG. 1, conventional tube support member stop means can be provided relative to the travel paths of the feed belts 11,31 for controlling the feed of the tube support members 25,28, respectively, onto the disk 13.

If the sensors 39,40 signal the control unit 41 that no further tube support member 25,28 is arriving at either of the respective feed locations, the control unit 41 can correspondingly de-activate the operation of the disk 13 and the tube gripping assembly 14 until further tube support members are available for feeding to the disk 13.

As an alternative to advancing the tube gripping assembly 14 to reposition the tubes and packages onto adjacent tube support members, the control unit 41 can be configured to control the tube gripping assembly 14 to only execute vertical movements and the disk 13 to rotate backward one spacing to effect the same relation repositioning as described above. With this equivalent alternative, the take-away belts 20 and 34 would be spaced from their associated feed belts 11 and 31 an even number of position spacings and the first advance of the disk 13 will be equivalent to three position spacings followed by subsequent two spacing advances.

In FIG. 4, another embodiment of the tube transport assembly of the present invention is illustrated. A spinning machine 1 includes the belt 3, the projecting members 4 and the sliding support member 6 as discussed with respect to the embodiment illustrated in FIG. 1 for transport of the spinning machine tube support members 25 in an endless transport path around the spinning machine. A winding machine 2 includes the delivery and discharge assembly discussed with respect to the embodiment illustrated in FIG. 1 for transport of the winding machine tube support members 28 in an endless transport path. Each endless transport path associated with the spinning machine 1 and the winding machine 2 includes a tube transfer portion. The tube transfer portion of the spinning machine 1 includes a conventional flexible endless member or spinning machine discharge belt 54 which can be located at the location at which the belt 23 of the embodiment illustrated in FIG. 1 is located. The spinning machine discharge belt 54 is aligned with one of the sliding support members 6 and is trained around a guide roller 54'' and a conventional drive roller (not shown), which is operatively connected to a conventional drive motor (not shown) for driving operation of the spinning machine discharge belt 54. The tube transfer portion of the spinning machine 1 additionally includes a conventional flexible endless member or spinning machine delivery belt 52, which can be located at the location at which the spinning machine discharge belt 8 of the embodiment illustrated in FIG. 1 is located, is aligned with the other sliding support member 6. The spinning machine delivery belt 52 is trained around a conventional guide roller (not shown) and a drive roller 52' which is connected to a drive motor 53 for driving operation of the spinning machine delivery belt 52. The belts 52,54 extend parallel to one another.

The tube transfer portion of the winding machine 2 includes a conventional flexible endless member or winding machine discharge belt 55 which can be located at the location at which the belt 29 of the embodiment illustrated in FIG. 1 is located. The winding machine discharge belt 55 is aligned with the discharge assembly of the winding machine 2 for receiving the winding machine tube support members 28 therefrom and is trained around a conventional guide roller (not shown) and a drive roller 55', which is operatively connected to a drive motor 56 for driving operation of the belt. The tube transfer portion of the winding machine 2 additionally includes a conventional flexible endless member or winding machine supply belt 57 which can be located at the location of the winding machine delivery belt 36 in the embodiment illustrated in FIG. 1. The winding machine supply belt 57 is trained around a guide roller 57'' and a conventional drive roller (not shown), which is operatively connected to a conventional drive motor (not shown) for driving operation of the winding machine supply belt 57. The belts 55,57 extend parallel to one another.

The segment of each tube transfer portion of the spinning machine 1 and winding machine 2 which interconnects the belts 52,54, respectively, and the belts 55,57, respectively, is co-extensive. The co-extensive segment is formed by the travel path of a common transfer portion belt 49 extending transversely to the belts 52,54,55 and 57. The common transfer portion belt 49 is trained around a guide roller 49'' and a drive roller 49', which is connected to a drive motor 51 for driving operation of the common transfer portion belt 49. The upstream end of the belts 54,57 are disposed relatively adjacent the downstream end of the common transfer portion belt 49 on respective opposite lateral sides thereof. The downstream ends of the belts 52,55 are disposed relatively adjacent the upstream end of the common transfer portion belt 49 on respective opposite lateral sides thereon. A plurality of guide plates 50 extend laterally inwardly from each respective lateral side of the belts 49,52,54,55 and 57 for centered guiding of the tube support members 25,28. Each tube support member 25,28 includes an annular collar portion coaxially mounted to its annular base portion and the annular collar portions of the tube support members 25,28 are of equal diameter. The annular base portions of the spinning machine tube support members 25 and the winding machine tube support members 28 can be of different diameters. For example, in the embodiment illustrated in FIG. 4, the two annular base portions of the winding machine tube support members 28 are of lesser diameter than the annular base portions of the spinning machine tube support members 25. The guide plates 50 extend from each respective lateral side of each belt to define a spacing therebetween slightly greater than the diameter of the annular collar portions of the tube support members 25,28.

The tube transport assembly includes alternating positioning means for positioning the spinning machine tube support members 25 in alternating manner with the winding machine tube support members 28. The alternating positioning means includes a pair of sensors 80,81 operatively connected via connectors 80',81', respectively, to the control unit 58 and a pair of stop members 82,83 operatively connected via connectors 82',83', respectively, to the control unit 58. The sensors 80,81 are disposed relative to the travel path of the spinning machine delivery belt 52,55, respectively, for sensing the presence of a tube support member 25,28, respectively, thereon. The stop members 82,83 are disposed relative to the travel paths of the belts 52,55, respectively, for preventing further travel of the tube support members 25,28, respectively, past a stop location. Each stop member 82,83 can be configured, for example, as a conventional solenoid-type stop member having a selectively retractable and extendable arm for effecting stopping of the tube support members 25,28. The stop members 82,83 control the feed of the tube support members 25,28, respectively, to the common transfer portion belt 49 to effect alternate positioning of the tube support members 25,28 on the common transfer portion belt 49.

A transfer path clearing means in the form of a stop member 84 is disposed relative to the travel path of the common transfer portion belt 49 and is operatively connected via a connector 84' to the control unit 58. The stop member 84 can be configured, for example, as a conventional solenoid-type stop member having a selectively extendable and retractable arm for selectively stopping the further travel of the tube support members 25,28 along the travel path of the common transfer portion belt 49. The stop member 84 is positioned relatively shortly upstream from the junction of the common transfer portion belt 49 and the belts 54,57.

A controllable discharge means includes a pivotable arm member 87 pivotally mounted to one of the guide plates 50 relatively adjacent the downstream end of the common transfer portion belt 49 at the junction of the travel paths of the belts 49,54 and 57. The pivotable arm member 87 is operatively connected via a connector (not shown) to the control unit 58 and is pivotable between a winding machine discharge position in which it extends across the travel path of the spinning machine tube support members 25 from the common transfer portion belt 49 to the spinning machine discharge belt 54 and a spinning machine discharge position in which it extends across the travel path of the winding machine tube support members 28 from the common transfer portion belt 49 to the winding machine supply belt 57. The pivotable arm member 87 is disposed at generally the same height as the annular collar portions of the tube support members 25,28 for engaging these annular collar portions during guiding of the tube support members 25,28. A downstream traffic sensor 86 is operatively connected via a connector 86' to the control unit 58 and is disposed relative to the travel path of the common transfer portion belt 49 relatively shortly upstream of the stop position of the stop member 84.

An upstream traffic sensor 85 is operatively connected via a connector 85' to the control unit 58 and is disposed relative to the travel path of the common transfer portion belt 49 shortly downstream of the tube support member feeding location of the common transfer portion belt 49 for sensing the presence of a tube support member in a substantially stationary condition.

The tube transport assembly illustrated in FIG. 4 operates as follows. The spinning machine delivery belt 52 transports the spinning machine tube support members 25 with the full packages 26 supported thereon, from the sliding support member 6 toward the common transfer portion belt 49. The winding machine discharge belt 55 transports the winding machine tube support members 28, with the empty tubes 27 supported thereon, from the discharge assembly of the winding machine 2 toward the common transfer portion belt 49. The sensors 80,81 sense the travel therepast of the tube support members 25,28, respectively, and, in response to the sensing, the control unit 58 controls the stop members 82,83 to control the feeding of the tube support members 25,28, respectively, onto the common transfer portion belt 49. The control unit 58 alternately controls the stop member 82 to extend its arm at an angle across the travel path of the spinning machine tube support members 25 to prevent further travel thereof while concurrently controlling the sensor 83 to retain its arm in a retracted position to thereby permit a winding machine tube support member 28 to travel from the winding machine discharge belt 55 onto the common transfer portion belt 49. In correspondence with the passage of the winding machine tube support member 28 onto the common transfer portion belt 49, the control unit 58 controls the stop member 83 to extend its arm at an angle across the travel path of the winding machine tube support members 28 to prevent further travel of the next following winding machine tube support member 28. Additionally, the control unit 58 controls the stop member 82 to retract its arm in correspondence with the travel of the one winding machine tube support member 28 onto the common transfer portion belt 49 to permit the respective spinning machine tube support member 25 that had been in stopped engagement with the arm of the stop member 82 to thereafter travel from the spinning machine delivery belt 52 onto the common transfer portion belt 49 upstream of the one winding machine tube support member 28 now traveling on the common transfer portion belt 49. After the one spinning machine tube support member 25 has traveled past the stop position of the stop member 82, the control unit 58 controls the stop member 82 to again extend its arm to prevent the next following spinning machine tube support member 25 from further travel. The control unit 58 then cyclically controls the operation of the stop members 82,83 to effect alternate feed of the tube support members 25,28 from their respective belts 52,55 onto the common transfer portion belt 49. The common transfer portion belt 49 is continuously operated to advance the tube support members 25,28 loaded thereon toward its downstream end.

When a predetermined number of the tube support members 25,28 have been loaded onto the common transfer portion belt 49, the control unit 58 controls the stop members 82,83 to extend their arms to thereby prevent further travel of the tube support members 25,28 onto the common transfer portion belt 49. The fully loaded condition of the common transfer portion belt 49 can be monitored, for example, by the upstream traffic sensor 85, which senses the condition of a substantially stationary tube support member and signals the control unit 58 via the connector 85'. One of the tube support members 25,28 will remain in a substantially stationary condition at the sensing location of the downstream traffic sensor 85 when a sufficient number of the tube support members 25,28 extend between the substantially stationary tube support member and the stop location of the stop member 84.

The leading tube support member 25,28 which is supported on the common transfer portion belt 49 at the stop location of the downstream stop member 84 is an empty tube support member which does not support a tube thereon. This tube support member is placed in the condition of having no tube thereon in the previous tube transfer operation in the manner described below. The remaining tube support members 25,28 are disposed in alternating relation with one another along the common transfer portion belt 49 so that each full package 26 is adjacent an empty tube 27. The center-to-center spacing of each adjacent pair of the tube support members 25,28 is uniform.

The tube transfer operation is effected by a conventional tube gripping means (not shown) which operates similarly to the tube gripper assembly 14 of the embodiment illustrated in FIG. 1 except that the tube gripper means is operable to move the gripped full packages 26 and the gripped empty tubes 27 in a linear direction aligned with the travel path of the common transfer portion belt 49 instead of along an annular advancing direction. The tube gripping means engages the full packages 26 and the empty tubes 27 supported on the common transfer portion belt 49 in a groupwise manner and raises the gripped full packages and empty tubes to clearance positions out of clearance with the posts of the tube support members 25,28. The tube gripping means then moves the gripped full packages 26 and the empty tubes 27 in incremental movements of linear travel which correspond to multiples of the uniform center-to-center spacing of the tube support members 25,28 along the common transfer portion belt 49. In the configuration in which the tube support members 25,28 are alternately positioned with one another, the tube gripping means moves each gripped full package 26 and empty tube 27 the distance of one tube support member center-to-center spacing to effect positioning of each full package 26 on a winding machine tube support member 28 adjacent the spinning machine tube support member 25 from which the full package is transferred and positioning of each empty tube 27 into a spinning machine tube support member 25 adjacent the winding machine tube support member 28 from which the empty tube is transferred. The leading tube support member 25,28, which has no tube thereon, receives the respective full package 26 or empty tube 27 from the adjacent, next following tube support member 25,28 as a result of this tube transfer operation. The trailing tube support member 25,28 on the common transfer portion belt 49 has its respective full package 26 or empty tube 27 transferred by this tube transfer operation and is thus placed in an empty status to become the leading tube support member in the next tube transfer operation.

Once the full packages 26 and the empty tubes 27 have been released onto their new tube support members 28,25, respectively, the control unit 58 controls the pivotable arm member 87 to selectively guide the tube support members 25,28 from the common transfer portion belt 49 onto the respective spinning machine discharge belt 54,57 associated with the respective endless transport path along which the tube support member is transported. The control unit 58 can be configured to count each pivoting movement of the pivotable arm member 87 between its winding guiding position and its spinning guiding position to determine when all of the tube support members 25,28 supported on the common transfer portion belt 49, except for the trailing empty tube support member, have been transferred from the common transfer portion belt 49 to the spinning machine 1 or the winding machine 2. In correspondence with this counting, the control unit 58 controls the stop member 54 to extend its arm across the travel path of the common transfer portion belt 49 to prevent further travel of the trailing empty tube support member therebeyond. The control unit 58 then again cyclically controls the feeding of the tube support members 25,28 onto the common transfer portion belt 49 to load the belt for another tube transfer cycle.

In one variation of the embodiment illustrated in FIG. 4, the discharge of the tube support members 25,28 from the common transfer portion belt 49 can be performed without a counting operation. In this variation, the downstream traffic sensor 86 is configured as a sensor having the capability to sense both the presence of a tube support member and the presence of a tube supported on the tube support member. The downstream traffic sensor 86 would provide a signal corresponding to each sensing to the control unit 58. When the trailing empty tube support member is sensed by the downstream traffic sensor 86, a second sensing signal would not be generated since there would be no tube supported on the tube support member and the control unit 58 can be configured to respond to the receipt of this single signal from the downstream traffic sensor 86 by controlling the stop member 84 to extend its stop arm.

In another variation of the embodiment illustrated in FIG. 4, the drive motor 51 for driving operation of the common transfer portion belt 49 can be operatively connected to the control unit 58. In this variation, the tube gripping means would be controlled to only raise and lower the gripped full packages 26 and empty tubes 27 without moving these gripped full packages and empty tubes in a linear movement. The drive motor 51 would be controlled by the control unit 58 to drive the common transfer portion belt 49 in a backward direction opposite to its advancing direction in incremental movements to effect positioning of the tube support members 25,28 on the belt with the respective full packages 26 and the empty tubes 27 which are to be released onto the tube support members. This variation avoids linear movement of the gripped full packages 26 and the empty tubes 27 which can detrimentally result in misalignment of the full packages 26 and the empty tubes 27 with the post members of the tube support members onto which they are released due to rotation of the full packages and the empty tubes about their axes.

Figure 5:
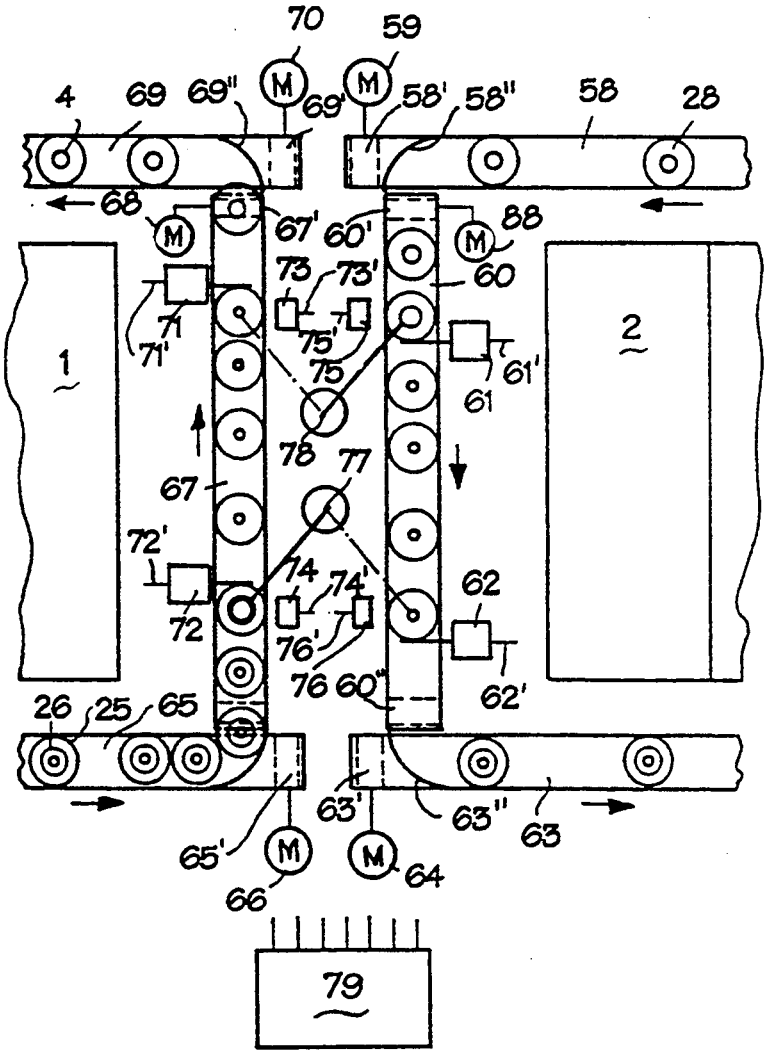
FIG. 5 is a plan view of a textile machine system comprising a spinning machine and a winding machine and showing a further embodiment of the tube transport assembly of the present invention installed thereon.

In FIG. 5, a further embodiment of the present invention is illustrated. A pair of conventional endless belts 65,69, each disposed along a respective side of a spinning machine 1 and trained around a drive roller 65',69', respectively, are provided for supporting a plurality of spinning machine tube support members 25 on which yarn is built to form the full packages 26. The belts 65,69 are driven through their respective drive rollers 65',69', respectively, by a conventional drive motor 66,70, respectively.

The endless belt 65 is a spinning machine discharge belt operable to transport the spinning machine tube support members 25 having the full packages 26 supported thereon in a direction toward a transfer location for transfer of the full packages to a winding machine 2. The endless belt 69 is a delivery belt operable to transport the spinning machine tube support members 25 with empty tubes 4 thereon in the direction away from the winding machine 1 for re-supplying the spinning stations of the spinning machine 2 with the empty tubes 4. A conventional endless belt 67 extending along one end of the spinning machine 1 transversely between the discharge and delivery belts 65,69 is trained around a conventional guide roller and a drive roller 67', which is operatively connected to a conventional drive motor 68 for driving operation of the transverse belt 67. An arcuate guide member 69'' extends from the travel path of the winding machine supply transverse belt 67, to the travel path of the delivery belt 69 for guiding the spinning machine tube support members 25 from the transverse belt 67 to the delivery belt 69. Another arcuately shaped guide member operates in a manner similar to the arcuately shaped guide member 69'' to guide the spinning machine tube support members 25 from the discharge belt 65 to the transverse belt 67. The discharge belt 65, the transverse belt 67 and the delivery belt 69 comprise a portion of an endless transport path along which the spinning machine tube support members 25 are transported around the spinning machine 1.

The winding machine 2 includes an endless transport path for the transport of the winding machine tube support members 28 therealong to, through and from the winding stations of the winding machine. The endless transport path is comprised of a conventional endless member or end belt 60 extending transversely at the end of the winding machine 2 adjacent an end of the spinning machine 1 and extending generally parallel to the travel path of the transverse belt 67 of the spinning machine. The transverse belt 60 is trained around a guide roller 60'' and a drive roller 60', which is operatively connected to a motor 88 for driving operation of the transverse belt 60. A winding machine delivery belt 63 extends from a location adjacent the downstream end of the travel path of the transverse belt 60 along one longitudinal side of the winding machine 2 and is trained around a conventional guide roller (not shown) and a drive roller 63' The drive roller 63' is connected to a drive motor 64 for driving operation of the delivery belt 63. An arcuately shaped guide member 63" extends across the juncture of the transverse belt 60 and the delivery belt 63 for guiding the travel of the winding machine tube support members 28 from the transverse belt 60 to the delivery belt 63.

A winding machine discharge belt 58 extends along the other longitudinal side of the winding machine 2 parallel to the travel path of the delivery belt 63 and is trained around a conventional guide roller (not shown) and a drive roller 58'. The drive roller 58' is operatively connected to a drive motor 59 for driving operation of the discharge belt 58. The discharge belt 58 transports the winding machine tube support members 28 from the winding stations of the winding machine 2 with the empty tubes 4 supported on the winding machine tube support members 28. The discharge belt 58 extends to a location adjacent the upstream end of the transverse belt 60 and an arcuately shaped guide member 58" extends across the juncture of the discharge belt 58 and the transverse belt 60 for guiding the travel of the winding machine tube support members 28 from the discharge belt 58 to the transverse belt 60.

A spinning machine feed stop member 71 is disposed relative to the travel path of the transverse belt 67 and is operatively connected via a connector 71' to a control unit 79. A spinning machine discharge stop member 72 is disposed relative to the travel path of the transverse belt 67 upstream of the feed stop member 71 and is operatively connected via a connector 72' to the control unit 79. The stop members 71,72 can be configured, for example, as conventional solenoid-type stop members having arms selectively extendable into the travel path of the transverse belt 67 for stopping the spinning machine tube support members 25 at respective stop locations.

A spinning machine discharge sensor 73 is disposed for sensing a spinning machine tube support member 25 stopped at the stop location associated with the discharge stop member 71 and is operatively connected via a connector 73' with the control unit 79. A spinning machine feed sensor 74 is disposed relative to the travel path of the transverse belt 67 for sensing a spinning machine tube support member 25 stopped at the stop location associated with the feed stop member 72 and is operatively connected via a connector 74' with the control unit 79. The sensors 73,74 are operable to sense the presence of a spinning machine tube support member 25 at the respective stop locations.

A winding machine feed stop member 61 is disposed relative to the travel path of the transverse belt 60 and is operatively connected via a connector 61' to the control unit 79. A winding machine discharge stop member 62 is disposed relative to the travel path of the transverse belt 60 downstream of the stop member 61 and is operatively connected via a connector 62' to the control unit 79. The stop members 61,62 can be configured, for example, as conventional solenoid-type stop members having arms selectively extendable into the travel path of the transverse belt 60 to stop a winding machine tube support member 28 at respective stop locations.

A winding machine feed sensor 75 is disposed relative to the travel path of the transverse belt 60 for sensing a winding machine tube support member 28 at the feed stop location associated with the stop member 61 and is operatively connected via a connector 75' to the control unit 79. A winding machine discharge sensor 76 is disposed relative to the travel path of the transverse belt 60 for sensing a winding machine tube support member 28 at the stop location associated with the discharge stop member 62 and operatively connected via a connector 76' to the control unit 79. The sensors 75,76 are operable to sense the presence of a winding machine tube support member 28 at the respective stop locations.

An empty tube gripper assembly in the form of a conventional individual empty tube gripper 78 is disposed between the travel paths of the transverse belts 67 and 60 for transferring empty tubes 4 from the winding machine tube support members 28 stopped at the stop location associated with the winding machine feed stop member 61 to the spinning machine tube support members 25 stopped at the stop location associated with the spinning machine discharge stop member 71. A full package tube gripping member in the form of a conventional individual full package gripper 77 is disposed between the travel path of the transverse belts 67 and 60 for individually transferring the full packages 26 from the spinning machine tube support members 25 stopped at the stop location associated with the spinning machine feed stop member 72 to the winding machine tube support members 28 stopped at the stop location associated with the winding machine discharge stop member 62.

The operation of the tube transport assembly illustrated in FIG. 5 is as follows. The spinning machine tube support members 25, with the full packages 26 supported thereon, are advanced by the discharge belt 65 to the transverse belt 67. The control unit 79 controls the spinning machine feed stop member 72 to extend its arm across the travel path of the transverse belt 67 to sequentially individually stop each spinning machine tube support member 25 at its associated stop location. In this regard, the control unit responds to sensing signals from the sensor 74 indicating the presence of a spinning machine tube support member 25 at the stop location. The spinning machine tube support members 25 which have had their full package 26 transferred therefrom are advanced along the travel path of the transverse belt 67 to the stop location associated with the spinning machine feed stop member 71.

The winding machine discharge belt 58 transports the winding machine tube support members 28 with the empty tubes 4 thereon to the transverse belt 60.

The sensor 75 senses the presence of a winding machine tube support member 28 at the discharge stop location and the control unit 79 responds to this sensing by controlling the discharge stop member 61 to extend its arm transversely across the travel path of the transverse belt 60 to cyclically individually stop the winding machine tube support members 28.

The sensor 76 senses the presence of the winding machine tube support members 28 at the discharge stop location and the control unit responds to this sensing by controlling the discharge stop member 62 to extend its arm transversely across the travel path of the transverse belt 60 to cyclically individually stop the winding machine tube support members 28 at the stop location. The control unit 79 then controls the full package gripper 77 to cyclically transfer a full package 26 from a spinning machine tube support member 25 to a winding machine tube support member 28 stopped at the discharge stop location as described above.

The control unit 79 controls the empty tube gripper 78 to transfer the empty tubes 4 supported on the winding machine tube support members 28 to the empty spinning machine tube support members 25 stopped at the stop location associated with the spinning machine discharge stop member 71. In this regard, the sensor 75 senses the presence of a winding machine tube support member 28 which has been stopped by the winding machine feed stop member 61 and the sensor 73 senses the presence of an empty spinning machine tube support member 25 stopped by the spinning machine discharge stop member 71. The control unit 79 controls the empty tube gripper 78 to cyclically transfer the empty tubes 4 from the winding machine tube support members 28 to the empty spinning machine tube support members 25 in correspondence with the cyclic stopping of another winding machine tube support member 28 and another spinning machine tube support member 25 at their respective stop locations. The winding machine tube support members 28 which have had their empty tubes 4 transferred therefrom are further advanced along the travel path of the transverse belt 60 to the stop location associated with the winding machine feed stop member 62. The tube transport assembly illustrated in FIG. 5 therefore is operable to transfer the empty tubes 4 and the full packages 26 between the endless transport paths of the spinning machine 1 and the winding machine 2. Although each endless transport path includes a tube transfer portion which is adjacent to the tube transfer portion of the other endless transport path, the respective tube support members 25,28 travel only in their associated endless transport path without risk of mixing with the tube support members of the other endless transport path.

In one variation of the tube transport assembly illustrated in FIG. 5, the control unit 79 can be configured to maintain a count of the sensing signals received from the feed stop sensor 74 and the sensing signals can be associated with the respective spinning station at which the full package 26 supported on the sensed spinning machine tube support member 25 was produced. This would enable the control unit to maintain information concerning the respective spinning station at which each full package 26 is produced. This information can then be transmitted, for example, to a conventional encoding device located relative to the stop location associated with the winding machine discharge stop member 62 for encoding of the information into a conventional information carrying device on the corresponding winding machine tube support members 28 stopped thereby. The winding machine tube support member 28 would then carry the encoded information relating to the full package 26 supported thereon so that operational problems arising from the yarn end preparation or unwinding operations performed on the full package 26 can, if necessary, be traced to the respective spinning station at which the full package 26 was produced.

In FIGS. 6–11, an additional embodiment of the tube transport assembly of the present invention is illustrated in its operating position in a textile machine system comprising a spinning machine and a winding machine. The winding machine includes a first transport means for transporting a plurality of tube support members 101 along an endless transport path associated with the winding machine. The winding machine transport means includes a winding machine discharge assembly 107 having an endless belt 108 trained around a guide roller 108' and a conventional drive roller (not shown) which is operatively connected to a conventional drive motor (not shown) for driving operation of the endless belt 108 in the direction shown by the arrow in FIG. 6. Additionally, the winding machine transport means includes a winding machine feed assembly 109 which includes an endless belt 110 trained around a guide roller 110' and a conventional drive roller (not shown), which is operatively connected to a conventional drive motor (not shown) for driving operation of the endless belt 110 in the direction shown by the arrow in FIG. 6.

Each of the tube support members 101, as seen in FIG. 8*a*, includes an annular base component having an upper annular portion and a lower tapering portion tapering inwardly from the upper annular portion toward the bottom surface of the tube support member. Additionally, each tube support member 101 includes an annular neck component 101' of lesser diameter than its annular base component and coaxially mounted thereto and a post component coaxially mounted on its annular neck component 101' for receiving a tube 104 inserted thereon for upright support of the tube during travel of the tube support member 101.

Figure 6:
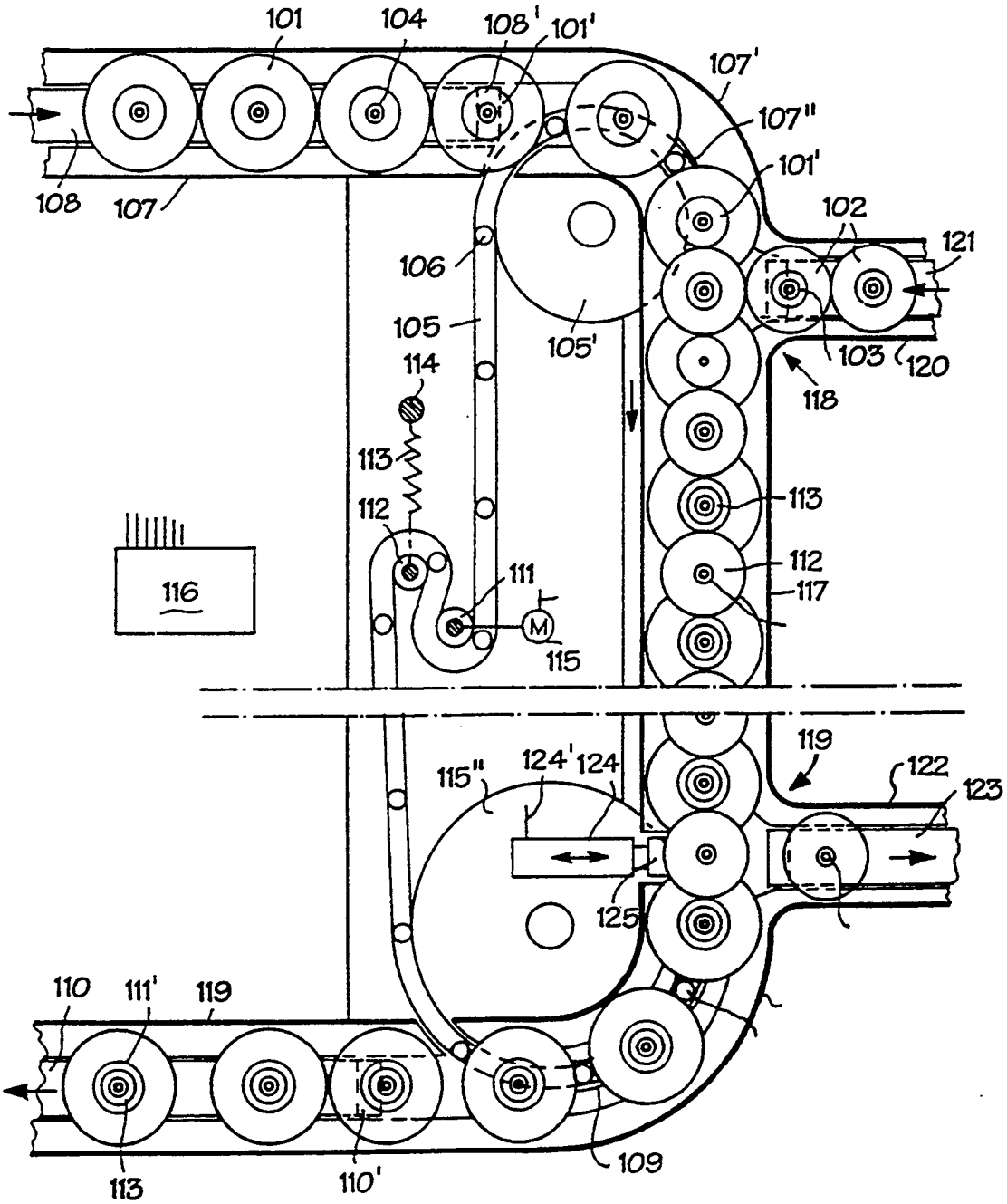
FIG. 6 is a perspective view of a textile machine system comprising a spinning machine and a winding machine and showing an additional embodiment of the tube transport assembly of the present invention installed thereon.

The additional embodiment of the tube transport assembly also includes a spinning machine transport means for transporting a plurality of tube support members 102 from a spinning machine operatively associated with the winding machine along a spinning machine endless transport path. As seen in FIG. 6, the spinning machine transport means includes a spinning machine discharge assembly 120 having an endless belt 121 for transporting the tube support members 102 in the direction shown by the arrow in FIG. 6. Additionally, the spinning machine transport means includes a spinning machine feed assembly 122 having an endless belt 123 trained around a conventional guide roller and a conventional drive roller (not shown), which is operatively connected to a conventional drive motor (not shown) for driving operation of the endless belt 123 in the direction shown by the arrow in FIG. 6.

A portion of the winding machine endless transport path and a portion of the spinning machine endless transport path are coextensive with one another along a coextensive transport path 117. As seen in FIG. 6, the winding machine discharge assembly 107 is connected to the coextensive transport path 117 by a guide assembly 107' and the winding machine feed assembly 109 is operatively connected to the other end of the coextensive transport path 117 by a guide assembly 109'. The downstream end of the spinning machine discharge assembly 120 is communicated at a juncture 118 with the coextensive transport path 117 at a location downstream of the guide assembly 107' relative to the direction of travel of the tube support members through the coextensive transport path 117. The upstream end of the spinning machine feed assembly 122 is operatively connective to the coextensive transport path 117 at a juncture 119 at a location upstream of the guide assembly 109' relative to the direction of transport of the tube support members along the coextensive transport path 117.

The guide assembly 107' includes a pair of overhang flanges extending over the transport path of the tube support members 101 being guided by the guide assembly 107'. Each overhang flange 101 includes an edge in facing relation to the edge of the other overhang flange and the pair of edges defined therebetween an arcuate spacing of greater diameter than the annular neck component 101' of a tube support member 101 yet of lesser diameter than the annular base component of the tube support member for travel of each tube support member 101 along the guide assembly 107' with its arcuate neck portion extending between the pair of overhang flanges and its annular base component traveling below the overhang flanges.

The guide assembly 109' includes a pair of overhang flanges each having an edge in facing relation to the edge of the other overhang flange, the pair of edges defining therebetween an arcuate spacing along which the annular neck component 101' of a tube support member 101 can freely travel.

As seen in FIG. 6, the additional embodiment of the tube transport assembly shown in FIG. 6 includes an alternating positioning means for positioning the tube support members 101 being discharged from the winding machine discharge assembly 107 in alternating manner with the tube support members 102 being discharged from the spinning machine discharge assembly 120 along the coextensive transport path 117. The alternating positioning means includes a transport belt 105 trained around a pair of guide pulleys 105' and 115" a tensioning pulley 112, and a drive pulley 111. The drive pulley 111 is operatively connected to a drive motor 115, which is operatively connected via a connector 115' to a control unit 116 for driving operation of the transport belt 105. The tensioning pulley 112 is operatively connected via a tensioning spring 113 to a post 114 fixedly mounted to the frame of the winding machine. The tensioning pulley 112 is not fixedly mounted to the winding machine but is, instead, freely translatably movable relative thereto under the bias of the tensioning spring 113 to maintain the transport belt 105 in sufficient tension with the drive pulley 111 for smooth driving operation of the transport belt 105.

Figure 12:
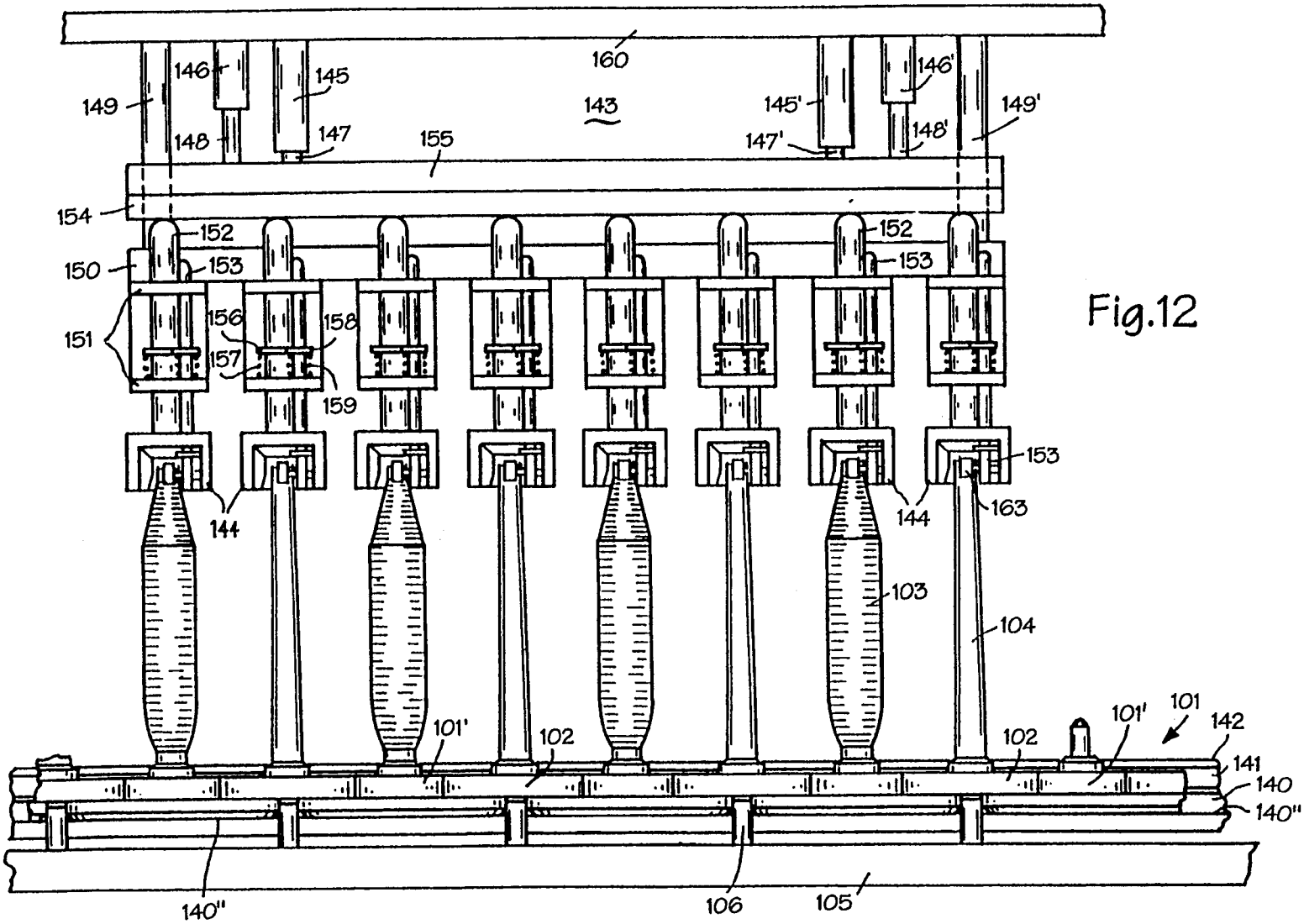
FIG. 12 is an enlarged front elevational view of a variation of the simultaneously gripping means of the textile machine system shown in FIGS. 7 and 8.

As seen in FIGS. 6 and 12, the transport belt 105 includes a plurality of drive members 106 mounted at uniform spacings therealong. Each drive member 106 is in the form of a post extending perpendicularly relative to the endless extent of the transport belt 105 and is dimensioned with a height sufficient to extend upwardly beyond the lower tapering portion of each tube support member 101 but insufficient to extend beyond the top of the upper annular portion of each tube support member 101.

The guide pulley 105' guides the transport belt 105 along an arcuate travel path portion extending centrally along the guide assembly 107' in which the drive members 106 are positioned for engaging and driving the tube support members 101 from the downstream end of the winding machine discharge assembly 107 along the guide assembly 107' to the coextensive transport path 117. The uniform spacing between each adjacent pair of the drive members 106 is selected such that each drive member 106 is positioned between a respective adjacent pair of the tube support members 101 exiting the winding machine discharge assembly 107, with the respective drive member 106 engaging the upper annular portion of the leading one of the respective adjacent pair of the tube support members 101 for driving transport thereof.

The guide pulley 105" is positioned adjacent the guide assembly 109' for guiding the drive members 106 along an arcuate travel path portion extending centrally along the guide assembly 109' from the downstream end of the coextensive transport path 117 to the upstream end of the winding machine feed assembly 109.

As seen in FIGS. 6 and 12, the alternating positioning means alternatingly positions each tube support member 102 between a respective adjacent pair of the tube support members 1 and, to accomplish this alternating positioning, the uniform spacing of the drive members 106 along the transport belt 105, the diameters of the annular base component and annular neck component 101' of each tube support member 101 and the diameter of the annular base component of each tube support member 102 are selected in correspondence with one another to ensure a reliable and stable alternating positioning of the tube support members 101 and 102 with one another. As seen in particular in FIGS. 7–9, the juncture 118 at which the tube support members 102 exit the spinning machine discharge assembly 120 and enter the coextensive transport path 117 is constructed such that the bottom surfaces of the tube support members 102 exiting the spinning machine discharge assembly 120 are generally at the height of the top surface of the annular base components of the tube support members 101 being transported along the coextensive transport path 117. Due to this support of the tube support members 102 at this predetermined height relative to the tube support members 101, each tube support member 102 smoothly and reliably slides between a respective adjacent pair of the tube support members 101 on the coextensive transport path 117 for support on the top surfaces of the annular base components of the respectively adjacent pair of the tube support members 101 during advancing movement of the tube support members 101 along the coextensive transport path.

As seen in particular in FIG. 12, each respective adjacent pair of the tube support members 101 which have been fed into the coextensive transport path 117 are separated from one another by a respective one of the drive members 106 extending upwardly therebetween. The distance between the annular neck components 101 of each respective adjacent pair of the tube support members 101 in the coextensive travel path 117 is equal to the product of two times the difference between the radius of the annular base component of a tube support member 101 and the radius of its annular neck component 101' plus the cross sectional extent of a drive member 106 and this distance is relatively slightly greater than the diameter of the annular base component of a tube support member 102. Accordingly, the annular base component of each tube support member 102 fits between the annular neck components 101 of the respective adjacent pair of the tube support members 101 on which the respective tube support member 102 is supported in the coextensive transport path 117 with only a relatively small clearance whereby each tube support member 102 is stably supported during its transport.

The alternating positioning means includes an ejector assembly 124 in the form of a hydraulic cylinder and piston device having an ejector head 125 mounted on the free end of the piston. The cylinder is operatively connected via a connector 124' to the control unit 116. The ejector assembly 124 is positioned adjacent the downstream end of the coextensive travel path 117 for ejecting the tube support members 102 from their supported positions on the tube support members 101 onto the spinning machine feed assembly 122.

The alternating positioning means can be configured in one of several configurations for alternatingly positioning the tube support members 101 and 102. In one configuration, as illustrated in FIG. 6, the transport belt 105 is driven in an intermittent motion in which the transport belt is cyclically advanced and stopped. The stopping of the transport belt 105 is controlled by the control unit 116 in such a manner that each oncoming adjacent pair of the tube support members 101 being guided by the guide assembly 107' onto the coextensive transport path 117 are stopped at a feed position at the juncture 118 for the receipt of a tube support member 102. The spinning machine discharge assembly 120 can be continuously operated to continuously advance the tube support members 102 into the juncture 118 or the endless belt 121 of the spinning machine discharge assembly 120 can be operated intermittently in coordination with the intermittent operation of the transport belt 105. The delivery of each tube support member 102 onto the respective pair of the tube support members 101 on which it is to be supported can be accomplished through coordinated driving operation of the transport belt 105 and the endless belt 121 to effect delivery of the tube support member by the endless belt 121 as the respective adjacent pair of the tube support members 101 is advanced into the receipt position by the transport belt 105. Alternatively, the endless belt 121 can be operated to deliver the tube support members 102 to its downstream end and the colliding action of the next arriving tube support member 102 with the respective tube support member 102 at the downstream end of the endless belt 121 can be used to effect loading of the tube support members 102 into their alternating positions with the tube support members 101.

The tube transport assembly illustrated in FIGS. 6-12 also includes tube transfer means for transferring the tubes 104 and the full yarn packages 103 between the tube support members 101 and 102 positioned in the coextensive transport path 117. The tube transfer means cyclically performs a tube transfer process by which the full yarn packages 103, which are initially supported on the tube support members 102, are transferred from the tube support members 102 to the tube support members 101 and, at the same time, the tubes 104, which are initially supported on the tube support members 101, are transferred from the tube support members 101 to the tube support members 102. The simultaneous transfer of the tubes 104 and the full yarn packages 103 occurs as the respective tube support members 101 and 102 on which the tubes and full yarn packages are supported are positioned in the coextensive travel path 117. Accordingly, when the tube support members 101 and 102 are discharged from the coextensive travel path 117 onto the winding machine feed assembly 109 and the spinning machine feed assembly 122, respectively, the tube support members 101 each support a full yarn package 103 and the tube support members 102 each support an empty tube 104.

In FIGS. 7-9, one variation of the alternating positioning means is illustrated and includes a feed control lever 129 pivotally mounted via a pivot 130 to a support flange 131 which is mounted to, and extending outwardly from, the outward overhang flange of the guide assembly 107'. The feed control lever 129 includes a profiled cam surface 129' and a nose portion 132 pivotally mounted to the lever at a location spaced from the pivot 130 by a pivot 139. A spring 134 is coiled about the pivot 139 and has one end fixedly secured to the feed control lever 129 and its other end fixedly secured to the nose portion 132 for biasing the nose portion 132 to pivot in a counterclockwise direction relative to the pivot 139 against a stop portion 135 formed on the feed control lever 129. A spring is coiled about the pivot 130 and has one end 136 fixedly mounted to the support flange 131 and its other end 137 fixedly mounted to the feed control lever 129. The spring biases the feed control lever 129 to pivot in a clockwise direction about the pivot 130.

The alternating positioning means also includes a discharge control lever 126 pivotally mounted by a pivot 128 to a flange 127 extending from one flange 140 of the coextensive travel path 117 on one lateral side of the coextensive travel path opposite the lateral side on which the juncture 119 is formed. As seen in FIG. 8*a*, a spring 138 is coiled around the pivot 128 and has one end fixedly connected to the discharge control lever 126 and its other end fixedly connected to the flange 127 for biasing the discharge control lever 126 to pivot in a counterclockwise direction about the pivot 128.

The feed control lever 129 operates as follows to control the feed of the tube support members 102 from the spinning machine discharge assembly 120 to the coextensive travel path 117 at the juncture 118. As seen in FIG. 7, the feed control lever 129 is biased by the spring 137 into a position in which the nose portion 132 is maintained in engagement with the annular neck component 101' of the tube support member 102 which has just previously been fed into the coextensive travel path 117. In this position, the nose portion 132 is held against the stop portion 135 on the feed control lever 129 due to the bias of the spring 134 coiled around the pivot 139. As seen in FIG. 8, as the transport belt 105 advances the tube support members 101 and 102 along the coextensive travel path 117, the tube support member 101 which will next enter the coextensive travel path is being guided along the guide assembly 107' due to the driving action of the transport belt 105 and the tube support member reaches a position in which the annular neck component 101' of the full yarn package 103 supported thereon engages the cam profile 129' of the feed control lever 129 and effects pivoting of the feed control lever 129 in a counterclockwise direction about the pivot 130 against the bias of the spring on the pivot 130. As the feed control lever 129 pivots, the annular neck component 101' of the respective tube support member 102 supported at the downstream end of the endless belt 121 engages the nose portion 132 to cause pivoting of the nose portion about the pivot 139 against the bias of the spring 134. Although the nose portion 132 pivots, it offers sufficient resistance against the tube support member 102 to prevent the forward motion of the tube support member.

As seen in FIG. 9, as the transport belt 105 continues to advance the tube support members 101 and 102, the respective tube support member 101 supporting the full yarn package 103 which has engaged the cam profile 129' continues to be advanced and the feed control lever 129 is further pivoted to the position shown in FIG. 9 in which the nose portion 132 clears the annular neck component 101' of the respective tube support member 102 supported at the end of the endless belt 121. The respective tube support member 102 is thereupon freed to be moved under the action of the endless belt 121 onto the top surfaces of the annular base components of the next available pair of adjacent tube support members 101 entering the coextensive travel path 117. The spring coiled about the pivot 139 pivots the nose portion 132 in a counterclockwise direction about the pivot 139 into its position against the stop portion 135.

As the respective tube support member 104 which is supporting the full yarn package 103 in engagement with the cam profile 129' is advanced fully into the coextensive travel path 117 to receive the respective tube support member 102 thereon, the full yarn package 103 moves out of engagement with the cam profile 129', thereby allowing the spring 137 to pivot the feed control lever 129 in a clockwise direction about the pivot 130 into the start position shown in FIG. 7 for the start of another feed control step. The feed control lever 129 thus operates to prevent the feeding of the next tube support member 102 awaiting delivery into the coextensive travel path 117 until the respective adjacent pair of the tube support member 101 on which the tube support member 102 will be supported, have arrived in a receipt position in which the respective tube support member 102 can be reliably received thereon.

The discharge control lever 126 operates as follows to control the discharge of the tube support members 102 from the coextensive travel path 117 onto the endless belt 123 of the spinning machine feed assembly 122. As seen in FIGS. 7 and 8*a*, the spring coiled about the pivot 128 biases the discharge control lever 126 to pivot in a counterclockwise direction about the pivot 128 generally at the level of the annular neck component 101' of the tube support members 101 being advanced along the coextensive travel path 117. Since the annular base components of the tube support members 102 are generally at the same vertical level as the annular neck components 101 of the tube support members 101, as seen in FIG. 12, the discharge control lever acts under the bias of its spring to push each tube support member 102 from its supported position between a respective adjacent pair of the tube support members 101 onto the upstream end of the endless belt 123 as the tube support member 102 is advanced into engagement with the discharge control lever 126. As seen in FIG. 8, once the discharge control lever 126 has effected the discharge of a tube support member 102, the discharge control lever continues to pivot in a counterclockwise manner about its pivot 128 until the annular neck component 101' of the next arriving tube support 101 contacts the discharge control lever. Thereafter, as seen in FIG. 9, the discharge control lever 126 is moved against the bias of its spring 138 as the respective tube support member 101 continues to be advanced beyond the coextensive travel path 117 into the guide assembly 109', thereby positioning the discharge control lever for subsequent pivoting movement against the next succeeding tube support member 102.

As seen in FIGS. 7, 9, 13*a* and 13*b*, two pairs of guide flanges 140, 141 are disposed along the coextensive travel path 117 for guiding the tube support members 101, 102, respectively, therealong. Each guide flange 140 includes a generally horizontal base portion 140'', shown in FIGS. 13*a* and 13*b*, for supporting the tube support members 101 for sliding movement therealong under the driving action of the drive members 106. The pair of horizontal portions 140'' form therebetween a spacing through which the drive members 106 project. Each guide flange 140 extends vertically on one respective lateral side of the coextensive travel path 117 at a height corresponding to the diameter of an annular base component of a tube support member 101 for supporting the tube support members 101 in laterally centered relation during their travel along the coextensive travel path 117. An interconnecting piece 140' extends from each guide flange 140 laterally inwardly at a vertical level above the height of the top surface of the annular base component of the tube support members 101 in the coextensive travel path 117 and the guide flanges 141 extend vertically from the laterally inward edge of the interconnecting pieces 140' for maintaining the tube support members 102 in laterally centered relation during their travel along the coextensive travel path 117 as the tube support members 102 are supported on the tube support members 101. An overhang flange 142 extends from each one of the guide flanges 141 above the vertical level of the annular base component of the tube support members 102 in the coextensive travel path 117 for providing stability of the tube support members in a vertical direction perpendicular to the lateral direction and the advancing direction of the coextensive travel path 117.

Figure 13A:
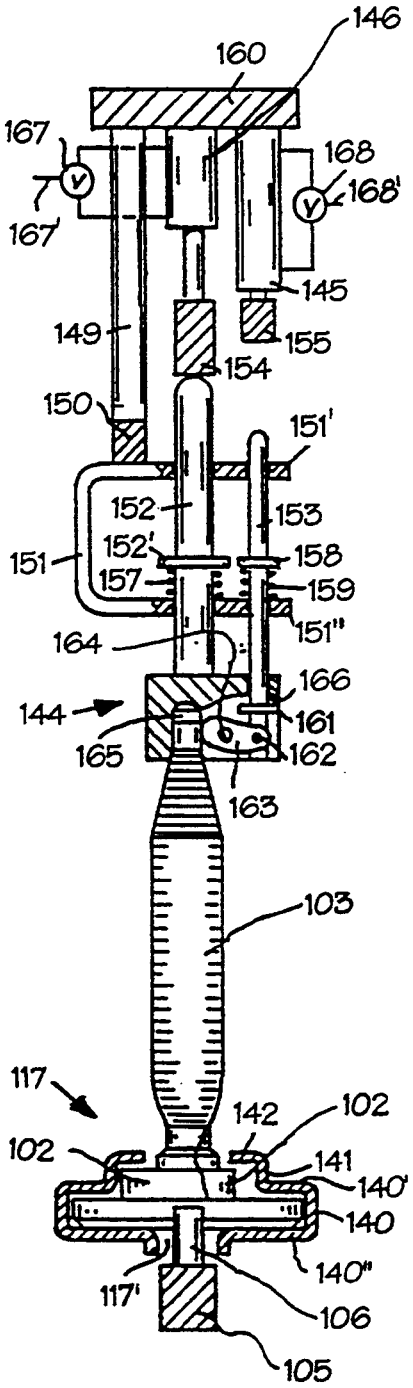
FIG. 13*a* is a side elevational view, in partial vertical section, of the variation of the simultaneously gripping means shown in FIG. 12 at a tube gripping position thereof.
Figure 13B:
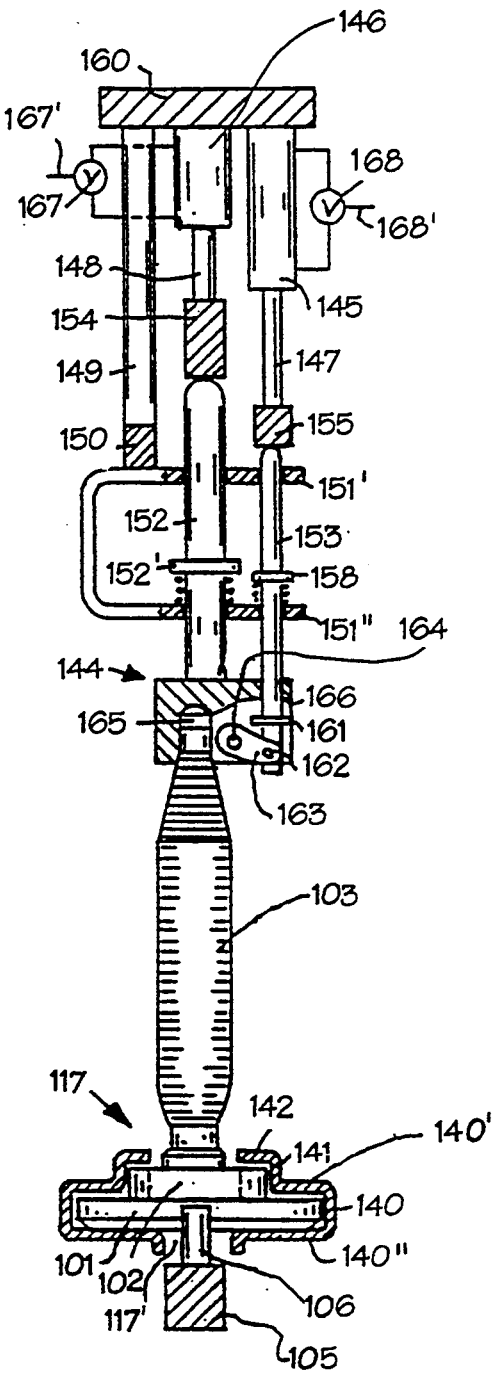
FIG. 13*b* is a side elevation view, in partial vertical section, of the variation of the simultaneously gripping means shown in FIG. 12 at a tube release position thereof.

As seen in FIGS. 12, 13*a* and 13*b*, in one variation of the tube transfer means of the additional embodiment of the tube transport assembly shown in FIGS. 6–12, a tube transfer means 143 includes a pair of spaced apart brackets 149, 149', each having one end fixedly mounted to a horizontal frame 160 and its other end fixedly mounted to a crossbar 150. A plurality of U-shaped brackets 151 are mounted to the underside of the crossbar 150 at uniform spacings therealong relative to the axial extent of the crossbar and each bracket 151 includes a pair of legs 151', 151'', as seen in FIGS. 13*a* and 13*b*, interconnected to one another by a vertically extending central portion. Each leg 151', 151'' includes a pair of throughbores formed therein, one throughbore being of slightly larger diameter than the other throughbore.

The tube transfer means 143 also includes a plurality of individual tube gripping assemblies 144, each comprising a gripper housing 166, a gripping housing traveler rod 152 having one end fixedly mounted to the top of the gripper housing 166, and a pivot lever 163 pivotally mounted to the gripper housing 166 by a pivot 164 and pivotally mounted to a lever traveler rod 153 by a pivot 162. Each gripper housing traveler rod 152 extends through the relatively larger diameter throughbores of the legs 151', 151'' of the respective bracket 151 associated with the gripper assembly 144 and each traveler rod includes a radially enlarged flange portion 152' disposed between the legs 151', 151''. A coil spring 157 is disposed between the radially enlarged flange 152' of each gripper housing traveler rod 152 and the upper surface of the leg 151'' of the respective associated bracket 151 for biasing the gripper assembly 144 to travel vertically upwardly.

Each lever traveler rod 153 extends through the relatively smaller diameter throughbores of the legs 151', 151'' of the respective associated bracket 151 and each lever traveler rod includes a radially enlarged flange 158 disposed intermediately the legs 151', 151''. A spring 159 is disposed between the radially enlarged flange 158 of each lever traveler rod 153 and the lower leg 151'' for biasing the lever traveler rod 153 to move vertically upwardly.

The tube transfer means 143 additionally includes a pair of hydraulic cylinders 146, 146' fixedly mounted at spaced apart positions to the frame 160, each hydraulic cylinder for selectively extending and retracting a piston 148. The free end of each piston 148 is fixedly mounted to a drive bar 154 extending parallel to the crossbar 150. The top surface of each gripper housing traveler rod 152 is biased by its spring 157 into engagement with the drive rod 154. The hydraulic cylinders 146, 146' are each operatively connected to a valve mechanism 167 for controlling the extension and retraction of the pistons 148, 148' and each valve mechanism 167 is connected via a connector 167' to the control unit 116.

The tube transfer means 143 further includes a pair of hydraulic cylinders 145, 145' mounted to the frame 160 at spaced apart positions, each hydraulic cylinder for selectively extending and retracting a piston 147, 147', respectively The free end of each piston 147, 147' is fixedly mounted to a lever drive bar 155 extending parallel to the crossbar 150. Each hydraulic cylinder 145, 145' is operatively connected to a valve mechanism 168 and the valve mechanisms 168 are operatively connected via connectors 168' to the control unit 166 for controlling the hydraulic cylinders 145, 145' to selectively extend and retract the pistons 147, 147', respectively.

Each lever traveler rod 153 also includes a radially enlarged flange 161 disposed between the pivot 162 and the gripper housing 166.

Figure 10A:
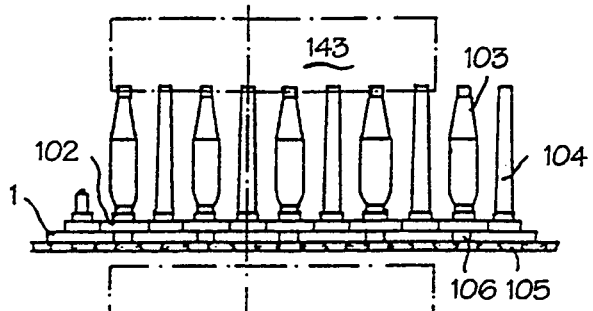
FIGS. 10*a–e* each are a front elevational schematic view of a portion of the textile machine system shown in FIGS. 7 and 8 and showing the operation of the simultaneously gripping means at a selected operational position thereof during a tube transfer operation.

With reference to FIGS. 10*a–e,* each of these figures schematically illustrate the tube transfer means 143 and the coextensive travel path 117 at different stages of a tube transfer operation in which the tube transfer means 143 operates as follows to simultaneously transfer each full yarn package 103 and each tube 104 from the respective one type of tube support member 101 or 102 on which it is supported to the other type of tube support members 101 and 102. The advancing movement of the tube support members 101 and 102 through the coextensive travel path 117 is stopped at a selected time for executing the simultaneous transfer process and the stopping of the advancing movement of the tube support members is controlled such that each full yarn package 103 and tube 104 is positioned in alignment with a respective one of the gripper assemblies 144 upon stopping of the advancing movement. Each gripper assembly 144 is in a clearance position prior to the stopping of the advancing movement of the tube support members and the positioning of the gripper assemblies 144 in their clearance positions is accomplished by controlling the hydraulic cylinders 146, 146' to extend their pistons 148, 148', respectively, to thereby allow the gripper housing traveler rods 152 to rise upwardly under the bias of their springs 157. As schematically illustrated in FIG. 10*a,* the cylinders 146, 146' are controlled to extend the drive bar 154 downwardly in correspondence with the stopping of the advancing movement of the tube support members in the coextensive travel path 117 to thereby effect simultaneous downward movement of the gripper housing traveler rods 152 against the bias of their springs 157 and this downward movement effects movement of the gripper housings 166 over the exposed top portions 165 of the full yarn packages 103 and the tubes 104.

During the downward movement of the gripper housings 166, the levers 163 are in their non-gripping positions as shown in FIG. 13*b* in which the levers are out of interference with the exposed top portions 165 of the tubes 104 and the tubes of the full yarn packages 103. The positioning of the levers 163 in their non-gripping positions during the downward movement of the gripper housings 166 is accomplished through control of the downward movement of the bar 155 in correspondence with the downward movement of the drive bar 154. Specifically, the control unit 116 controls the cylinders 145, 145' to extend the bar 155 downwardly in coordination with the downward movement of the drive bar 154 such that the levers 163 remain pivoted out of engagement with the exposed top portions 165 of the tubes 104 and the full yarn packages 103 as the gripping housings 166 are lowered over the exposed top portions.

In correspondence with the disposition of the gripper housings 166 over the exposed top portions 165 (i.e., the positions of the tube transfer means 143 shown in FIG. 13*b*), the control unit 116 controls the cylinders 145, 145' to retract the bar 155 to thereby allow the lever traveler rods 153 to rise upwardly under the bias of their springs 159. The upward movement of the lever traveler rods 153 effects pivoting of the levers 163 in a counterclockwise manner about the pivots 164, whereby the free ends of the levers 163 move into engagement with the exposed top portions 165 to compressively grip the exposed top portions 165 between the levers 163 and the gripper housings 166.

Figure 10B:
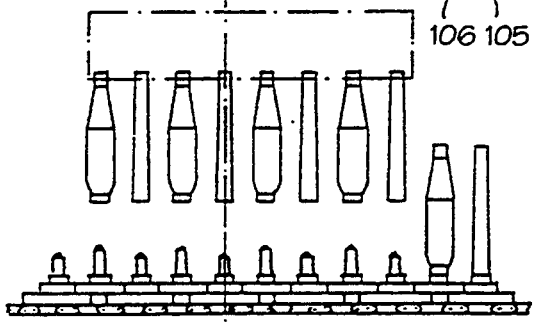
Figure 10C:
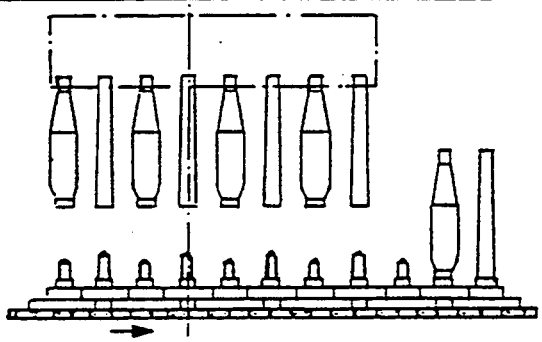

In correspondence with the simultaneous gripping of the exposed top portions 165 of the tubes 104 and the tubes of the full yarn packages 103, the control unit 116 controls the cylinders 146, 146' to retract the drive bar 154, as schematically illustrated in FIG. 10*b,* whereupon the gripper housing traveler rods 162 rise upwardly under the bias of their springs 157. The gripper housings 166 travel upwardly to raise the gripped tubes 104 and the gripped full yarn packages 103 upwardly beyond the post component of the tube support members 101 and 102, respectively, in which they are supported. In correspondence with the upward movement of the gripper housings 166, the tube support members 101 and 102 in the coextensive travel path 117 are each displaced in a direction opposite to the direction of advance in the coextensive travel path by an amount equal to the distance between the post component of a tube support member 101 and the post component of an adjacent tube support member 102 in the coextensive travel path 117, as schematically illustrated in FIG. 10*c.* This reverse displacement movement of the tube support members 101 and 102 brings each tube support member 101 in the coextensive travel path 117 into alignment with one of the gripped full yarn packages 103, except for the rearmost one of the tube support members 101 which previously supported one of the gripped tubes, since this tube support member is displaced beyond the gripped tubes and full yarn packages. Additionally, the advancing movement brings each tube support member 102 into alignment with a respective one of the gripped tubes 104.

Figure 10D:
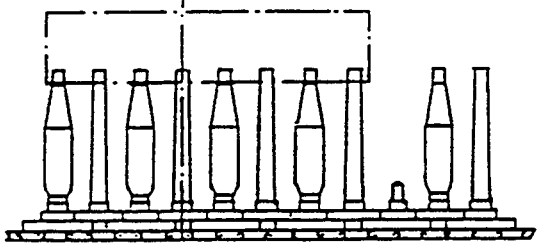
Figure 10E:
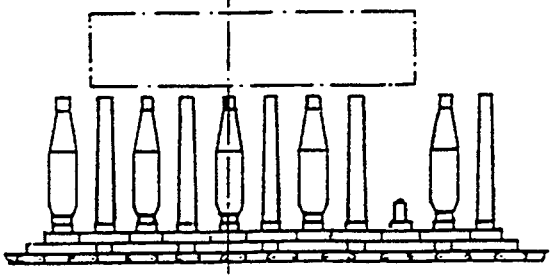

In correspondence with the reverse displacing movement of the tube support members 101 and 102 by an increment equal to the post-to-post spacing of the tube support members, the control unit 116 controls the cylinders 146 146' to lower the drive bar 154, as schematically illustrated in FIG. 10*d,* to thereby effect lowering of the gripped full yarn packages 103 and the gripped tubes 104 onto the tube support members newly aligned therewith. Thereafter, the control unit 116 controls the cylinders 145, 145' to downwardly move the lever drive bar 155. The downward movement of the lever drive bar 155 effects pivoting of the levers 163 in a clockwise direction about the pivots 164, thereby releasing the tubes 104 and the full yarn packages from their gripped condition. The gripper assemblies 144 are then returned to their clearance position, as shown in FIG. 10*e*.

Figure 11:
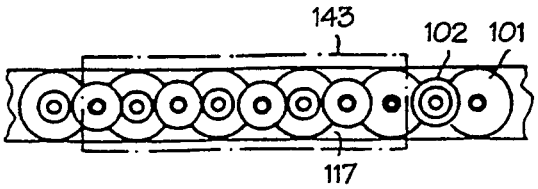
FIG. 11 is a top plan view of a portion of the alternating positioning means immediately after the simultaneously gripping means has completed a tube transfer operation.

As seen in FIG. 11, after the gripped full yarn packages 103 and the gripped tubes 104 have been released onto the respective new ones of the tube support members 101 and 102 which will thereafter support them, the control unit 116 controls the transport belt 105 to resume the advancing movement of the tube support members in the coextensive travel paths 117 and the feeding of the tube support members 102 at the juncture 118 and the discharge of the tube support members 102 at the juncture 119 resumes, as schematically illustrated in FIG. 11.

The present invention also contemplates that other tube gripping arrangements can be used in the tube transfer process. For example, German Offenlegungsschrift 17 10 054 discloses a tube gripping apparatus having a component which is inserted into the top portion of a textile tube and is thereafter expanded by the introduction of a pressurized medium thereinto to effect gripping of the textile tube.

Figure 14:
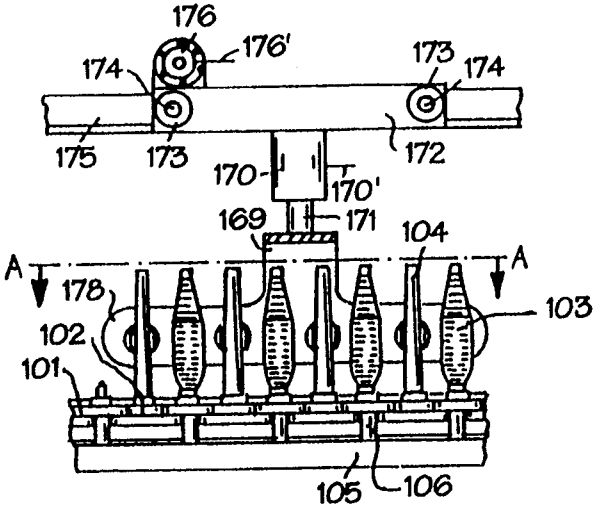
FIG. 14 is a front elevation view of another variation of the simultaneously gripping means of the textile machine system shown in FIGS. 7 and 8.

Alternatively, the present invention contemplates that a tube transfer means of the type illustrated in FIGS. 14–17 can be used to effect the tube transfer process. As seen in FIG. 14, in this variation, the tube transfer means includes a support frame 169 having a pair of legs 178 interconnected by a central portion. The support frame 169 has a cross sectional U-shape and supports a plurality of pairs of opposed hydraulic cylinders 179, 180. Each leg 178 of the support frame 169 supports one group of the hydraulic cylinders 179, 180 in alternating arrangement with one another with each adjacent pair of the cylinders 179, 180 being at a spacing from one another generally corresponding to the post-to-post spacing of an adjacent tube support member 101 and 102 in the coextensive travel path 117.

Figure 17:
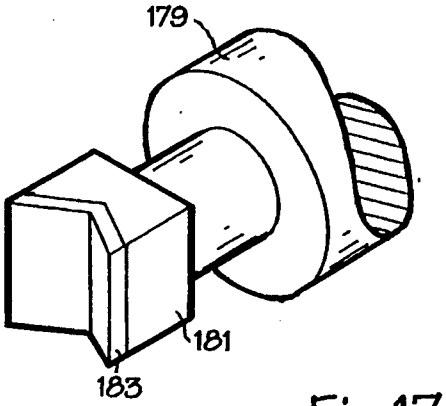
FIG. 17 is an enlarged perspective view of one gripping element of the another variation of the simultaneously gripping means shown in FIG. 14.

As seen in FIG. 17, each hydraulic cylinder 179, 180 includes a piston selectively extendable and retractable therefrom and having a gripper head 181 fixedly mounted to the free end of the piston. An elastomeric gripping surface component 183 is secured to the free end of each gripper head 181.

The support frame 169 is fixedly mounted to the free end of a piston 171 which is selectively extendable and retractable from a hydraulic cylinder 170, which is operatively connected via a connector 170' to the control unit 116. The cylinder 170 is fixedly mounted to a carriage 172 which includes two pairs of roller wheels 173 for rolling travel of the carriage 172 along a pair of parallel, spaced L-shaped flanged rails 175. One of the roller wheels 173 is operatively connected to a drive motor 176 for driving the carriage 172 along the rails 175 in a direction parallel to the coextensive travel path 117. The drive motor 176 is operatively connected via a transmission assembly 177 to the shaft 174 of the respective roller wheel 173 driven by the motor.

Figure 16:
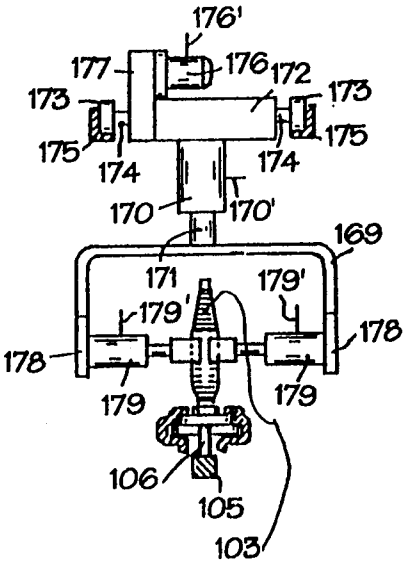
FIG. 16 is a side elevational view of the another variation of the simultaneously gripping means shown in FIG. 14.
Figure 15:
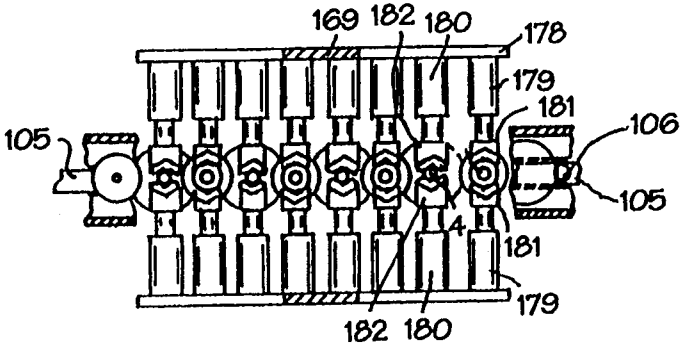
FIG. 15 is a top plan view of the another variation of the simultaneously gripping means shown in FIG. 14 taken along line A—A thereof.

As seen in FIGS. 15 and 16, each cylinder 179, 180 is in opposed relation to another cylinder of the same type and each pair of the opposed cylinders of each pair are operable to extend their respective gripper heads 181 into engagement with a respective one of the full yarn packages 103 or the tubes 104 being supported in the coextensive travel path 117. As seen in FIGS. 14 and 16, the gripper heads of each cylinder 179, 180 move into engagement with the full yarn packages 103 and the tubes 104 generally at the axial midpoint of these packages and tubes and, as seen in FIG. 15, since the tubes 104 are of relatively lesser diameter than the diameter of the full yarn packages 103, the respective group of opposed cylinder pairs operable to engage the tubes 104 are controlled to extend their respective gripper heads 181 relatively further than the extension of the gripper heads 181 of the other group of opposed cylinder pairs which grip the full yarn packages 103. The pairs of hydraulic cylinders which grip the tubes 104 are controllable to retract their respective gripper heads 181 to clearance positions which permit the support frame 169 relative to the full yarn packages 103 supported in the coextensive travel path 117 to be moved through rolling travel of the carriage 172 without interference between the gripper heads 181 and the full yarn packages 103.

Since the gripper heads 181 grip the full yarn packages 103 and the tubes 104 generally at their axial midpoints, the full yarn packages and tubes are effectively gripped at their centers of gravity, thereby optimally minimizing the risk that the gripped yarn packages and tubes will tip during their gripped engagement by the tube transfer means. The gripping and releasing of the full yarn packages 103 and the tubes 104 by the tube transfer means illustrated in FIGS. 14–17 is performed in generally the same manner as the gripping and releasing actions by the tube transfer means 143 described with respect to FIGS. 10*a–e*, except that the tube transfer means illustrated in FIGS. 14–17 includes the additional capability to move the gripped full yarn packages and tubes, whereby the tube support members 101 and 102 in the coextensive travel path 117 remain stationary throughout the tube transfer process. The carriage 172, through driving operation of its one driven wheel 173 by the drive motor 176, is operable to move the support frame 169, with each opposed pair of the hydraulic cylinders 179, 180 grippingly engaging a respective one of the full yarn packages or tubes, by a predetermined incremental amount to re-position the gripped full yarn packages and tubes for subsequent release onto new tube support members. The carriage 172 travels a uniform predetermined distance during each tube transfer operation and the present invention contemplates that any one of a number of conventional arrangements can be used to control the uniform predetermined travel of the carriage. For example, the roller wheels 173 can be in the form of annular gears and the rails 175 can be in the form of gear racks for meshing engagement with the roller wheels 173 in a rack-and-pinion type arrangement. Alternatively, stop members can be positioned relative to the rails 175 and the two respective end points of travel of the carriage 172 for signaling to the control unit 116 that the carriage 172 has arrived at an end point.

The variation of the tube transfer means illustrated in FIGS. 14–17 advantageously permits relatively rapid displacement of the gripped tubes and yarn packages relative to the tube support members in the coextensive travel path 117 due to the fact that the tubes and yarn packages are gripped generally at their centers of gravity. Moreover, the capability of the tube transfer means to displace the gripped tubes and full yarn packages eliminates the need for any reverse movement of the transport belt 105, as is required in a tube transfer operation performed by the tube transfer means 143 discussed with respect to FIGS. 6–12.

Although the preferred embodiments of the present invention are described with respect to a textile winding machine and a textile spinning machine, the present invention contemplates that the tube transport assembly can also be used in connection with any group of two or more textile machines regardless of whether any machine of the group is a winding machine or a spinning machine.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile machine system in which tubes having textile strand material wound thereon are transported from a textile spinning machine to a textile winding machine and empty tubes are returned from the textile winding machine to the textile spinning machine, a tube transport assembly, comprising:

a plurality of first tube support members for individually supporting tubes thereon for transport therewith during travel of the first tube support members on the textile winding machine;

a plurality of second tube support members for individually supporting tubes thereon for transport therewith during travel of the second tube support members on the textile spinning machine;

a first transport means for transporting the plurality of first tube support members along a first endless transport path associated with the textile winding machine, the first endless transport path including a tube transfer portion;

a second transport means for transporting the plurality of second tube support members along a second endless transport path on the textile spinning machine, the second endless transport path including a tube transfer portion; and tube transfer means for transferring tubes between those first tube support members and second tube support members being transported along the first and second tube transfer portions, said first and second tube transfer portions are at least partially coextensive.

2. In a textile machine system, the tube transport assembly according to claim 1 wherein said first and second endless paths each include a feed location for feeding tube support members to said tube transfer portions and a discharge location for discharging tube support members from said tube transfer portions, and each of said first and second tube support members includes a base component and a tube retaining component mounted on the base component, the tube retaining component for retaining a tube in an upright disposition on the respective tube support member, and spacing means for maintaining each of said first tube support members at a spacing from each adjacent first tube support member during advancing movement of the tube support members along said coextensive transport path, the spacing being selected such that a respective one of said second tube support members can be disposed in overlapping relation on the adjacent pair of first tube support members at said feed location for mutual support of the respective second tube support member by the adjacent first tube support members with the base component of the respective second tube support member being supported on the base components of the adjacent first tube support members.

3. In a textile machine system, the tube transport assembly according to claim 2 wherein each base component of each first tube support members has a top surface and the second transport means includes feeding ready support means for supporting a second tube support member in a feeding ready position at said feed location in which the second tube support member is supported for subsequent movement thereof onto an adjacent pair of said first tube support members being advanced along said coextensive transport path, the vertical position of said feeding ready support means being selected such that the respective second tube support member in said feeding ready position is at least at the same vertical level as the top surfaces of the base components of the adjacent pairs of said first tube support members being advanced along said coextensive transport path, whereby the respective second tube support member can be readily fed from its said feeding ready position into its supported overlapping position on adjacent first tube support members.

4. In a textile machine system, the tube transport assembly according to claim 3 wherein the second transport means includes discharge receiving means for receiving each second tube support member as it is discharged from said coextensive transport path, the vertical position of said discharge receiving means being at a vertical level no higher than the top surfaces of the base components of said first tube support members in said coextensive transport path at said discharge location.

5. In a textile machine system, the tube transport assembly according to claim 4 wherein the base component of each of said first tube support members is annular and the tube retaining component of each of said first tube support members includes a generally annular neck portion coaxially mounted on the annular base component and a post portion coaxially mounted on the generally annular neck portion and extending therefrom, the neck portion for supporting thereon a tube inserted over the post portion, and said spacing means includes means for maintaining adjacent first tube support members in said coextensive transport path at a spacing from one another such that the spacing between the annular neck portions of the adjacent first tube support members is at least equal to the diameter of the annular base portion of a second tube support member.

6. In a textile machine system, the tube transport assembly according to claim 5 wherein said spacing means includes a plurality of projecting members, projecting between adjacent support members in said coextensive transport path and means for moving said projecting members along said coextensive transport path with said projecting members at a uniform spacing from one another to effect advancing movement of said first tube support members along said coextensive transport path at constant uniform spacings from one another during their transport.

7. In a textile machine system the tube transport assembly accordingly to claim 6 and further comprising first guide means for engaging said first tube support members in said coextensive transport path to maintain said first tube support members in alignment during their transport and second guide means for engaging said second tube support members in said coextensive transport path to maintain said second tube support members in alignment during their transport by said first tube support members in said coextensive transport path.

8. In a textile machine system, the tube transport assembly according to claim 5 wherein the base component of each of said second tube support members is annular and the tube retaining component of each of said second tube support members includes a generally annular neck portion coaxially mounted to the annular base component and a post portion coaxially mounted to the generally annular neck portion and extending therefrom, the neck portion for supporting thereon a tube inserted the post portion, and the thickness of the base portion of said second tube support members is substantially equal to the axial extent of the neck portion of said first tube support members.

9. In a textile machine system, the tube transport assembly according to claim 4 further comprising means for moving said second tube support members at an angle to the direction of travel of tube support members along said coextensive transport path to cause discharge of said second tube support members at said discharge location onto said discharge receiving means of said second transport means.

10. In a textile machine system, the tube transport assembly according to claim 3 wherein said second transport means is operable to automatically feed a second tube support member in said feeding ready position to a supported disposition on an adjacent pair of said first tube support members and further comprising means for controlling the feed of a second tube support member from said feeding ready position in correspondence with the alignment of an adjacent pair of said first tube support members with said feeding ready position.

11. In a textile machine system, the tube transport assembly according to claim 10 wherein said controlling means includes a blocking member movable between a feed blocking position in which said blocking member extends across the travel path of a second tube support member in said feeding ready position for resisting feeding movement of the second tube support member from said feeding ready position and a clearance position in which said blocking member is out of interference with the second tube support member in said feeding ready position and means for biasing said blocking member into said blocking position.

12. In a textile machine system, the tube transport assembly according to claim 11 wherein said first transport means includes a guide channel along which said first tube support members are guided into said coextensive transport path and further comprising a pivot for pivotally mounting said blocking member to said guide channel, and said biasing means includes a spring mounted on the pivot of said blocking member.

13. In a textile machine system, the tube transport assembly according to claim 12 wherein the means for moving said second tube support members at an angle includes a pusher element and means for selectively moving said pusher element between a clearance position at which it is out of interference with said first and second tube support members in said coextensive transport path and an extended position at which it engages a respective one of said second tube support members being supported at said discharge location to effect movement of said second tube support member from the respective adjacent first tube support members on which it is supported onto said discharge receiving means.

14. In a textile machine system, the tube transport assembly according to claim 12 wherein said discharge receiving means is disposed laterally adjacent one side of said coextensive transport path and further comprising an ejection member pivotally mounted laterally adjacent the opposite side of said coextensive transport path and means for biasing said ejection member to pivot laterally inwardly of said coextensive transport path to engage each second tube support member at said discharge location to thereby cause movement of said second tube support members onto said discharge receiving means.

15. In a textile machine system, the tube transport assembly according to claim 2 wherein said tube transfer means includes means for simultaneously vertically moving the gripped tubes to clearance positions above said first and second tube support members in said coextensive transport path, said simultaneously vertical moving means being operable to maintain the gripped tubes in their vertical clearance positions during advancing movement of said first and second tube support members therebelow in said coextensive transport path and to lower tubes gripped from first tube support members onto second tube support members and tubes gripped from second tube support members onto first tube support members.

16. In a textile machine system, the tube transport assembly according to claim 15 and further comprising means for moving said first and second tube support members in said coextensive transport path in a direction opposite to the direction of advancing movement in coordination with the transfer of tubes between said tube support members.

17. In a textile machine system, the tube transport assembly according to claim 15 and further comprising means for moving said means for simultaneously gripping a plurality of tubes by a predetermined amount in the direction of movement of tube support members in the transfer path to thereby align each gripped tube with the other type of said first and second tube support members different than the one type of said first and second tube support members on which the tube is initially supported.

18. In a textile machine system, the tube transport assembly according to claim 2 and further comprising means for controlling the feed of said second tube support members onto adjacent first tube support members at said feed location, said controlling means controlling said second transport means to stop the feed of said second tube support members in coordination with the completion of feeding of a predetermined number of said second tube support members onto said first tube support members and for controlling said tube transfer means to perform a tube transfer operation resulting in a first tube support member without a tube thereon in coordination with the completion of feeding of said predetermined number of said second tube support members onto said first tube support members and to lower tubes gripped from first tube support members onto second tube support members and tubes gripped from second tube support members onto first tube support members and signal means for signalling the passage therepast of said first tube support member without a tube thereon, said controlling means controlling said second transport means to resume the feeding of said second tube support members onto adjacent first tube support members in response to said signal.

19. In a textile machine system, the tube transport assembly according to claim 1 and characterized further in that said tube transfer means includes means to simultaneously exchange said full packages from said second tube support members with empty tubes from said first tube support members.

20. In a textile machine system, the tube transport assembly according to claim 19 and characterized further in that said tube transfer means is operable to move said empty tubes and said full packages to clearance positions out of interference with said first and second tube support members during transfer of said empty tubes and said full packages.

21. In a textile machine system, the tube transport assembly according to claim 1 and characterized further by alternating positioning means for positioning said first tube support members in alternating manner with said second tube support members in said at least partially coextensive transfer portions and said tube transfer means includes means to simultaneously exchange said full packages from said second tube support members with said empty tubes from said first tube support members.

22. In a textile machine system, the tube transport assembly according to claim 21 and characterized further in that said alternating positioning means includes means for advancing said first and second tube support members along said at least partially coextensive tube transfer portions and feed control means for controlling the feed of said first and second tube support members to said advancing means to effect alternate positioning of said first and second tube support members on said advancing means.

23. In a textile machine system, the tube transport assembly according to claim 22 and characterized further in that said feed control means is operable to alternately feed said first and second tube support members to said advancing means.

24. In a textile machine system, the tube transport assembly according to claim 22 and characterized further in that the spacing between each respective tube support member positioned on said advancing means for transfer is uniform and said tube transfer means and said advancing means are movable relative to one another to effect movement of said empty tubes engaged by said tube transfer means to release positions for release of said empty tubes onto said second tube support members and movement of said full packages engaged by said tube transfer means to release positions for release onto said first tube support members.

25. In a textile machine system, the tube transport assembly according to claim 24 and characterized further in that said advancing means is operable to advance said first and second tube support members along said at least partially coextensive tube transfer portions in movements in which the extent of travel corresponds to multiples of said uniform spacing and said tube transfer means is operable to periodically engage said empty tubes and said full packages in correspondence with a predetermined number of said movements of said advancing means.

26. In a textile machine system, the tube transport assembly according to claim 25 and characterized further in that said tube transfer means is operable to periodically engage said empty tubes and said full packages in correspondence with each advancing movement of said advancing means.

27. In a textile machine system, the tube transport assembly according to claim 24 and characterized further in that said advancing means includes a rotatable annular tube support member retaining member and means for rotating said annular tube support member retaining member, said rotatable annular member having an odd number of tube support member retaining positions uniformly spaced annularly thereon for supporting said first and second tube support members on said tube support member retaining member in alternating positions.

28. In a textile machine system, the tube transport assembly according to claim 27 and characterized further in that said first transport means is operable to transport said first tube support members to an empty tube feed location for feed on said first tube support members, with said empty tubes thereon, onto said tube support member retaining member, and to transport said first tube support members from a full package discharge location at which said first tube support members, with said full packages supported thereon, are discharged from said rotatable annular member, said second transport means is operable to transport said second tube support members to a full package feed location for feed of said second tube support members, with said full packages thereon, onto said rotatable annular member and to transport said second tube support members from an empty tube discharge location at which said second tube support members, with said empty tubes supported thereon, are discharged from said rotatable annular member, each said feed and discharge location being in register with one of said tube support member retaining positions of said rotatable annular member upon completion of an advancing movement thereof and the feed and discharge locations associated with each respective first and second transport means being spaced from one another in the direction of advance of said rotatable annular member with an odd number of tube support member retaining positions therebetween.

29. In a textile machine system, the tube transport assembly according to claim 27 and characterized further in that said advancing means includes a plurality of releasable retaining assemblies, each disposed at a respective one of said tube support member retaining positions, to selectively releasably position and retain said first and second tube support members at said tube support member retaining positions.

30. In a textile machine system, the tube transport assembly according to claim 29 and characterized further in that said tube transfer means is operable to vertically raise said empty tubes and said full packages to clearance positions out of interference with vertical posts of the tube support members from which they are raised and said rotating means is operable to drivingly rotate said rotatable annular member in an advancing movement while said empty tubes and said full packages are held in their clearance positions to effect alignment of said empty tubes and said full packages with the vertical posts of the respective tube support members to which they are being transferred.

31. In a textile machine system, the tube transport assembly according to claim 27 and characterized further in that said tube transfer means includes a rotatable operating member rotatable concentrically with said rotatable annular tube support member retaining member, and a plurality of individual tube grippers annularly aligned with said tube support member retaining positions of said rotatable annular tube support member retaining member and mounted on said rotatable operating member for rotation therewith to engage, transfer and release gripped packages and tubes at respective retaining positions.

32. In a textile machine system in which tubes having textile strand material wound thereon are transported to, and empty tubes are transported from, a textile machine, a tube transport assembly, comprising:

a plurality of first tube support members for individually supporting tubes thereon for transport therewith;

a plurality of second tube support members for individually supporting tubes thereon for transport therewith;

a first transport means for transporting the plurality of first tube support members along a first endless transport path associated with said textile machine;

a second transport means for transporting said plurality of second tube support members along a second endless transport path, a portion of said first endless transport path and a portion of said second endless transport path being coextensive along a coextensive transport path;

alternating position means for positioning said first tube support members in alternating manner with said second tube support members in said coextensive transport path, said alternating positioning means including means for advancing said first and second tube support members along said coextensive transport path from a feed location at which the respective tube support members are fed to said alternating positioning means for positioning thereby to a discharge location at which the respective tube support members are discharged from said alternating positioning means; and tube transfer means for transferring tubes between tube support members positioned in said coextensive transport path, said tube transfer means including means for simultaneously gripping a plurality of tubes supported on tube support members in said coextensive transport path, said simultaneously gripping means including a plurality of individual tube gripping members each for individually gripping a tube and relative moving means for moving the tube support members in said coextensive transport path and said individual tube gripping members relative to one another during simultaneous gripping of tubes by said individual tube gripping members to move the gripped tubes from the respective tube support member on which they are initially supported to the other tube support members in said coextensive transport path, the respective tube support members initially supporting tubes being a group of a selected one type of said first and second tube support members and the other tube support members being the other type of the first and second tube support members and said tube transfer means being operable to transfer each tube after the respective tube support member on which the tube is initially supported has been fed to said alternating positioning means and before the other tube support member to which the tube is transferred has been discharged from said alternating positioning means.

33. In a textile machine system in which tubes having yarn wound thereon are transported to, and empty tubes are transported from, a textile machine, a transport assembly, comprising:

a plurality of first tube support members, each for individually supporting a first tube thereon for transport therewith;

a plurality of second tube support members, each for individually supporting a second tube thereon for transport therewith;

a first transport means for transporting said plurality of first tube support members along a first endless transport path associated with said textile machine;

a second transport means for transporting said plurality of second tube support members along a second endless transport path;

a portion of said first endless transport path and a portion of said second endless transport path being coextensive along a coextensive transport path; and tube transfer means for transferring said first and second tubes between said first tube support members and said second tube support member while said first and second tube support members are supported on said coextensive transport path, said tube transfer means including a plurality of individual tube gripping members each for individually gripping and releasing a respective one of said first and second tube supported on one of said first and second tube support members in said coextensive transport path, means for moving said individual tube gripping members, said moving means including means for moving each individual tube gripping member to effect raising of the respective tube gripped thereby from the respective tube support member on which it is supported along the axis of the tube to a raised position and means for moving each individual tube gripping member to effect lowering of each respective tube along the axis of the tube from its raised position to a release position at which the gripped tube is released onto a tube support member, means for advancing said first and second tube support members through said coextensive transport path in an advancing movement, and means for controlling the advancing movement of said advancing means in coordination with the raising and lowering movements of said individual tube gripping members to effect simultaneous transfer of each one of said fist tubes from the respective one of said first tube support members on which it is supported to one of said second tube support members and each one of said second tubes from the respective one of said second tube support members on which it is supported to one of said first tube support members, said controlling means controlling said advancing means to advance said first and second tube support members after said individual tube gripping members have raised the gripped tubes to raised positions and before said individual tube gripping members have lowered the gripped tubes to their release positions to thereby position each tube support member for the receipt of a tube released thereonto, with each tube support member receiving a tube different than the tube previously supported by the tube support member.

* * * * *